US009157322B2

(12) United States Patent
Benham

(10) Patent No.: US 9,157,322 B2
(45) Date of Patent: Oct. 13, 2015

(54) JOURNAL-LESS CRANKSHAFT AND NON-FRICTION VARIABLE SPEED TRANSMISSION WITH INHERENT CLUTCH AND FREE SPIN

(71) Applicant: Roger A. Benham, San Diego, CA (US)

(72) Inventor: Roger A. Benham, San Diego, CA (US)

( * ) Notice: Subject to any disclaimer, the term of this patent is extended or adjusted under 35 U.S.C. 154(b) by 0 days.

(21) Appl. No.: 14/223,039

(22) Filed: Mar. 24, 2014

(65) Prior Publication Data

US 2014/0224116 A1 Aug. 14, 2014

Related U.S. Application Data

(63) Continuation-in-part of application No. 13/492,024, filed on Jun. 8, 2012, now Pat. No. 8,677,971.

(51) Int. Cl.

| | |
|---|---|
| ***F04B 43/00*** | (2006.01) |
| ***F01B 19/02*** | (2006.01) |
| ***F04B 43/02*** | (2006.01) |

(52) U.S. Cl.

CPC ..... *F01B 19/02* (2013.01); *F04B 43/023* (2013.01)

(58) Field of Classification Search

CPC ..... F01B 19/02; F04B 43/00; F04B 43/023
USPC ..... 123/193.1, 193.2, 193.6; 92/50, 64, 89, 92/90, 92, 94, 96; 417/474, 475, 479, 480, 417/510, 520; 91/43
See application file for complete search history.

(56) References Cited

U.S. PATENT DOCUMENTS

| | | | | |
|---|---|---|---|---|
| 2,140,085 A | | 12/1938 | Maina | |
| 2,393,852 A | * | 1/1946 | Yingling | 123/41 R |
| 2,581,830 A | | 1/1952 | Averill | |
| 2,977,759 A | | 4/1961 | Milliken | |
| 3,736,747 A | | 6/1973 | Warren | |
| 3,826,081 A | | 7/1974 | Van Avermaete | |
| 3,839,858 A | | 10/1974 | Van Avermaete | |
| 3,872,852 A | * | 3/1975 | Gilbert | 123/193.1 |
| 3,893,295 A | | 7/1975 | Airas | |
| 3,932,987 A | | 1/1976 | Munzinger | |
| 4,024,702 A | | 5/1977 | Hudson | |
| 4,024,703 A | | 5/1977 | Hudson | |
| 4,133,172 A | | 1/1979 | Cataldo | |

(Continued)

FOREIGN PATENT DOCUMENTS

| | | | | |
|---|---|---|---|---|
| DE | 102007043313 A1 | * | 3/2009 | F04B 43/02 |
| WO | WO 99/44886 | | 9/1999 | |
| WO | WO 99/58832 | | 11/1999 | |

*Primary Examiner* — Lindsay Low
*Assistant Examiner* — Grant Moubry
(74) *Attorney, Agent, or Firm* — Welsh Flaxman & Gitler LLC

(57) ABSTRACT

A pressure driven apparatus comprising a housing, at least one flexible membrane located within the housing dividing the interior of the housing into at least two chambers. At least one input or exhaust cam assembly operates in conjunction with the at least one flexible membrane to provide an expansion zone within the housing. Fluid enters the housing producing movement of the flexible membrane. The flexible membrane is connected to a drive member such that the movement of the fluid within the expansion zone results in the membrane imparting a force to the drive member. The flexible membrane includes seals used to maintain a dynamic and movable seal with respect to the housing. A lightweight journal-less crankshaft and non-friction variable speed transmission with inherent clutch and free spin are also disclosed.

5 Claims, 22 Drawing Sheets

(56) References Cited

U.S. PATENT DOCUMENTS

| | | | |
|---|---|---|---|
| 4,201,047 | A | 5/1980 | Warren et al. |
| 4,212,163 | A | 7/1980 | Mikina |
| 4,453,508 | A | 6/1984 | Groeger |
| 4,653,269 | A | 3/1987 | Johnson |
| 4,867,121 | A | 9/1989 | Bivona et al. |
| 4,961,691 | A | 10/1990 | Waldrop |
| 5,024,170 | A | 6/1991 | Santanam et al. |
| 5,187,932 | A | 2/1993 | Shekleton |
| 5,222,466 | A | 6/1993 | Gratziani |
| 5,964,087 | A | 10/1999 | Tort-Oropeza |
| 6,470,679 | B1 | 10/2002 | Ertle |
| 6,886,326 | B2 | 5/2005 | Holtzapple et al. |
| 7,485,978 | B2 | 2/2009 | Pelrine et al. |
| 2006/0277744 | A1 | 12/2006 | Wink et al. |
| 2010/0031935 | A1 | 2/2010 | Vandyne et al. |

* cited by examiner

JOURNAL-LESS CRANKSHAFT AND NON-FRICTION VARIABLE SPEED TRANSMISSION WITH INHERENT CLUTCH AND FREE SPIN

CROSS-REFERENCE TO RELATED APPLICATIONS

The present application is a continuation-in-part of U.S. patent application Ser. No. 13/492,024 filed Jun. 8, 2012, entitled, "POSITIVE DISPLACEMENT MOTOR WITH APPLICATIONS INCLUDING INTERNAL AND EXTERNAL COMBUSTION, which is currently pending.

BACKGROUND OF THE INVENTION

1. Field of the Invention

The present invention relates to a pressure driven apparatus. In particular, the present invention relates to a pressure driven apparatus that functions by making use of a pressure differential on opposing sides of a membrane to produce a rotational power output. The pressure differential could be generated by any number of sources including pneumatics, combustion gases, hydraulics, head pressure from a column of water, or pressure differentials created by thermal gradients. The present invention also includes a lightweight journal-less crankshaft and non-friction variable speed transmission with inherent clutch and free spin.

2. Description of the Related Art

A number of forms of pressure driven motors are known. Pressure driven motors may function on a number of operating principles. However, in some examples, pressure driven motors function through pressure force acting upon a piston in a cylinder which is in turn connected to a crankshaft, a turbine rotor on a rotating shaft, a vane on a rotating shaft, or an impeller mounted on a shaft.

These pressure driven motor designs all suffer from a number of drawbacks, including complex construction, relatively low torque, relatively low displacement for the size of the unit, and the fact that significant damage may be caused to these pressure driven motors if the motor becomes overloaded.

Thus, there would be an advantage if it were possible to provide a pressure driven apparatus (particularly a pressure driven apparatus for a motor) that provides for the improved production of reliable and efficient power and work from potential energy sources. In turn, these advantages provide consumers with cleaner, more environmentally-friendly and more efficient options.

In conventional combustion apparatus, such as those used to provide the driving force to vehicles and the like, the combustion apparatus is an engine in which combustion takes place internally to the engine.

While engines of this kind have become widely used, they suffer from a number of drawbacks, including their bulky size, poorer efficiency, higher fuel consumption, higher level of hazardous emissions (such as nitrous oxides and carbon monoxide) and the higher cost of construction. In addition, conventional internal combustion engines are adapted to run on a single type of fuel only, making them relatively inflexible.

Some attempts have been made to overcome these drawbacks. For instance, a number of external combustion apparatuses have been developed in which a motor (or similar device) is powered using energy generated in a combustion apparatus located externally to the motor. However, these devices suffer from the drawbacks of having lower efficiency (including failing to recover waste heat), require combustion to occur at high temperatures, require cooling and do not provide for such typical vehicle conditions such as idling or instant starting.

Thus, there would be an advantage to provide an external combustion apparatus that demonstrated relatively high efficiency, relatively low emissions and was capable of being operated using multiple types of fuel.

External combustion and pressure driven device designs all have their shortcomings. The present invention is designed to create an improved external combustion and pressure driven motor device to help overcome the disadvantages of the existing art.

Some benefits include:

More compact power source
Lower NOx and CO emissions
Higher efficiency
Lower fuel consumption
Multi-fuel capability
Elimination of cooling requirement
Regenerative braking
No idling and Instant starting
Waste heat recovery
Low cost materials of construction
Computer controlled operation All of these features are important to create an improved method and apparatus to produce clean and reliable power from combustible energy or other energy sources. This results in more options for the consumer and a cleaner environment.

It will be clearly understood that, if a prior art publication is referred to herein, this reference does not constitute an admission that the publication forms part of the common general knowledge in the art in the United States or in any other country.

SUMMARY OF THE INVENTION

An object of the present invention is to provide a pressure driven apparatus, which may at least partially overcome at least one of the abovementioned disadvantages or provide the consumer with a useful or commercial choice.

In one aspect, the invention resides broadly in a pressure driven apparatus comprising a housing, at least one flexible membrane located within the housing so as to divide the interior of the housing into a plurality of chambers, one or more inlets through which a pressurized fluid enters the housing and one or more outlets through which the pressurized fluid exits the housing, and wherein the membrane is adapted for connection to a drive member such that movement of the pressurized fluid within the housing results in the membrane imparts a force to the drive member.

The housing may be of any suitable shape, size or configuration. However, it is preferred that the housing is constructed from a material of suitable strength and rigidity to withstand the pressure changes and/or temperature changes experienced within the housing as the pressurized fluid enters and exits the apparatus. For instance, at least the inner surfaces of the housing may be fabricated from metals, nonmetals, ceramics, composite materials or nanotechnology materials.

The membrane may be of any suitable construction. However, in a preferred embodiment of the invention, the membrane is fabricated from a flexible material. In addition, it is preferred that the membrane is fabricated from a pressure-resistant material, such that changes in the pressure inside the housing do not cause the membrane to burst or rupture. For instance, the membrane may be fabricated from nonmetals, such as reinforced high density plastic, rubber, metal or the like, or any combination thereof. The membrane may be linear, tubular, corrugated, or the like in construction.

Importantly, the membrane will typically be of a fixed length and with a higher tensile strength with minimum elasticity. It is also preferable that one end of each of the membranes or a portion of each of the membranes is fixed relative to a portion of the housing (such as an inner surface of the housing). In this manner, injection of the pressurized fluid will preferably cause deformation of the shape of the membrane and because one end or portion of the membrane is fixed relative to the housing, an opposite end of the membrane will move towards the point to which one end of the membrane is fixed to the housing. It is important to note that the membrane will be flexible by virtue of its geometry (moment of inertia, I), but with minimum elasticity by virtue of its tensile strength (modulus of elasticity, E). For example in the case of using a steel band for the membrane, the steel band will be very flexible because of its thinness, such as a thickness of 0.030 inches and a width of one inch. However, the steel band will have great tensile strength and minimum elasticity because of its high yield strength and modulus of elasticity (100,000 psi, and 30 million psi, respectively).

In some embodiments of the invention, the membrane may be provided with reinforcement to increase the strength of the membrane. Any suitable reinforcing material, such as cords, strips, ropes, cables, wires, bars, rods, corrugated materials, layered materials or the like (both metallic and non-metallic) may be used. Reinforcement may be located through the entire membrane or only in particular locations, such as the area at which the pressurized fluid enters the apparatus and impacts directly upon the membrane.

Preferably, the membrane is adapted for connection to the drive member, such as, but not limited to, a crankshaft, camcrank, or a piston at a first end, that is the end opposite the fixed end. In preferred embodiments of the invention, the second end of the membrane is adapted for connection to the housing. Preferably, the second end of the membrane is adapted for connection to an inner wall of the housing. It is envisaged that the second end of the membrane will be securely held against the inner wall of the housing, although it is preferred that the engagement between the membrane and the housing is a removable engagement so that the membrane may be removed from the housing for repair of replacement.

In an embodiment of the present invention, the flexible membrane will be provided with a pair of W-shaped seals provided between upper and lower strips of the membrane as well as a corrugated mid-section. A tubular spring is provided between each of the W-shaped seal and the corrugated mid-section. These springs would exert a force between the side walls of the housing.

The membrane may be connected directly to the drive member. This is particularly the case if only a single membrane is in use. In other embodiments of the invention (and particularly those in which multiple membranes are present), the membranes may be connected to the drive member via a connecting member. For instance, two or more membranes may be connected to a common connecting member, such as a yoke, the yoke being connected to the drive member. In this way, consistent and simultaneous force may be applied to the drive member by all of the membranes.

Preferably, when the apparatus comprises a single membrane, it is preferred that the apparatus comprises a single inlet and a single outlet. In some embodiments, the inlet and the outlet may be the same aperture. Alternatively, a separate inlet and outlet may be provided. When more than one membrane is present, one or more inlets and/or outlets may be provided for each membrane.

In another embodiment of the present invention, the housing would include a separate intake chamber for the injection of pressurized fluid into the housing. A rotatable intake cam is used to open and close a passageway between the intake chamber and the housing. A fuel injector is used to inject fuel in the housing. This fuel combines with the pressurized fuel to combust when a spark is used to ignite the mixture in an expansion zone, thereby forcing the membrane to move, resulting in the movement of the drive member. A rotatable exhaust cam is used to open an exhaust port, allowing exhaust gas to exit from the housing.

In yet another embodiment of the present invention, a reed switch is used to open and close the passageway between the intake chamber and the housing. An exhaust fan is used to assist in the removal of the exhaust gas from the housing.

In yet a further embodiment of the present invention, the expansion zone is provided between two flexible membranes. The passageway between the intake chamber and the housing is opened and closed using two rotatable intake arms, allowing water to flow between a water reservoir and the expansion zone. Two rotatable exhaust cams are used to open and close an exhaust port to remove the water from the expansion zone.

In use, a pressurized fluid (such as a pressurized gas or pressurized liquid) is injected into the housing through the one or more inlets. As the fluid enters the housing, the membrane is displaced due to the pressure applied by the pressurized fluid, and the resulting pressure differential between adjacent chambers within the housing. Movement (such as by flexing) of the membrane imparts a force to the drive member. Subsequent to this, the pressurized fluid may then be released from the housing through the one or more outlets. Continued movement of the drive member (for instance, rotational movement, particularly rotational momentum) results in a movement of the membrane back to (or close to) their original position.

In embodiments of the invention in which the membrane is tubular, pressurized fluid may be forced into the interior of the tubular membrane, causing the membrane to expand outwardly. In a preferred embodiment, the tubular membrane expands to seal against the inner surface of the housing. In this embodiment of the invention, the tubular membrane may be provided with sealing means (for instance, one or more O-rings, gaskets or the like) that enhance the sealing of the tubular membrane against the inner surface of the housing.

In an alternative embodiment of the invention, flexing of the membranes may be achieved through a pressure differential caused by temperature gradients between adjacent chambers in the apparatus. For instance, one chamber may be supplied with fluid having a first temperature, while the second chamber may be supplied with a fluid having a temperature greater or less than the temperature of the fluid in the first chamber. In this embodiment of the invention, a separate heat transfer apparatus may be used to cause contraction and expansion of the fluid and therefore flexing of the one or more membranes. Any suitable device may be used to achieve this, such as, but not limited to, a Stirling engine or similar device.

The flow of pressurized fluid into the apparatus may be controlled using any suitable technique. For instance, valves may be provided on the inlets and/or outlets in order to control the flow and timing of the flow of pressurized fluid into and out of the apparatus. Alternatively, the pressurized fluid may be supplied from a fluid source (such as a gas bottle, fluid tap or the like on a timed basis so that fluid only flows into the apparatus during predetermined points in the operational cycle. In embodiments of the invention in which valves are present, any suitable form of valve may be used.

While the flow of pressurized fluid causes movement of the membrane (and therefore, the imparting of a force to the drive member), further force may be imparted to the drive member through the membrane via the use of one or more timing members adapted to act upon the one or more membranes. In this embodiment, the one or more timing members may be adapted to force the one or more membranes against an inner surface of the housing and create a pinch point (seal) that also serves to take up slack in the membrane. The action of the one or more timing members against the membrane causes a timing affect where the tension in the flexible membrane transmits force to the rotating member at the optimum time and for the optimum duration within the cycle.

In a preferred embodiment of the invention, the one or more timing members are adapted for rotation. For instance, the one or more timing members may comprise cams adapted to time the imparting of a force to the drive member. In some embodiments, each of the one or more membranes may be acted upon by one or more timing members.

In embodiments of the invention in which rotating timing members are present, the rotation of the timing members to certain positions in their rotation may further serve to permit the flow of pressurized fluid out of the apparatus through the one or more outlets. In this embodiment, the rotation of the timing members may push the pressurized fluid out of the apparatus through the one or more outlets, or, alternatively, the rotation of the one or more timing members may open a flow path to the one or more outlets for the pressurized fluid by releasing the one or more membranes from the pinch point created when the timing members force the one or more membranes against the inner surface of the housing, or against another membrane. Still further, the movement (for instance, rotational movement) of the drive member may result in applying a force (for instance, a tensive force) to the membrane which may open a flow path to the one or more outlets for the pressurized fluid.

It is envisaged that the force imparted by the one or more membranes to the drive member could be a linear force, such as that required to drive a piston. Alternatively, the drive member may be adapted to rotate, such that the force imparted by the movement of the one or more membranes results in the rotation of the drive member. Thus, in this embodiment of the invention, the drive member may be a shaft, such as, but not limited to, a crank shaft or a camcrank. In some embodiments of the invention, the drive member may be used to drive a motor or the like, although an artisan possessing ordinary skill in the art will understand that the drive member could be used to drive any suitable device.

In another aspect, the invention resides broadly in a pressure driven apparatus comprising a housing, a flexible tubular membrane having a hollow center located within the housing so as to divide the interior of the housing into a plurality of chambers, one or more inlets through which a pressurized fluid is injected into the chamber and one or more outlets through which the pressurized fluid exits the housing, and wherein the injection of the pressurized fluid causes the flexible tubular member to expand and impart a force to a drive member.

Preferably, the expansion of the flexible tubular member causes the flexible tubular member to seal against inner surface of the housing.

In a preferred embodiment of the invention, the flexible tubular member may be provided with sealing means for enhancing the sealing of the flexible tubular member against the inner surface of the housing and/or reinforcement means.

Any suitable sealing means may be used, such as, but not limited to, O-rings, gaskets, linear metallic or non-metallic seals, or the like. Similarly, any suitable reinforcement means may be used, such as, but not limited to cords, strips, ropes, cables, wires, bars, rods, corrugated materials, layered materials or the like (both metallic and non-metallic), or any combination thereof.

Various configurations, modifications, and additions can be added to modify and improve the operating characteristics of this invention. For example, multiple membranes can be configured together in parallel, opposing, in series, in stages, or radially. A variety of cam configurations or no cam at all, hydraulics, pneumatics, acme screws, AC or DC motors, linear drives, shims, or gears of any style, can be used to affect the timing of the power, exhaust cycles, or power transmission application of the device. A wide varied of membrane materials could be used for different applications.

One example of this invention includes an application of an improved external combustor and device for providing pressurized gas to conduct work, such as, but not limited to, driving a low-pressure-gradient positive displacement motor to produce rotational power output. For example, the external combustor described can provide heated and pressurized gas to any pressure-driven motor such as a rotary gear, rotary vane, turbine, or piston driven motor. Additionally, the external combustor and the low pressure-gradient positive displacement motor can be combined to produce a device for energy storage and regenerative braking, which may at least partially overcome the deficiencies in the prior art or provide the consumer with a useful or commercial choice.

In the described external combustion device, the combustion takes place in a separate pressurized combustion vessel that is supplied with a liquid, solid, gas or combination thereof organic fuel and two separate streams of compressed air, one from a lower pressure air compressor and one from a higher pressure air compressor. The combustion gases produced by igniting the fuel with the higher pressure air stream are accelerated and blended with the lower pressure air stream in a manner to produce a mixture of a high temperature pressurized working gas. The design includes features of regenerative cooling of the combustion vessel, improved combustion characteristics, and higher efficiency. In the preferred embodiment, the device for providing the compressed air to the lower and higher pressure air receivers is accomplished by an axial or screw-type compressor interconnected to a demand-controlled continuously variable transmission driven by the output motor, an ancillary motor, or the driving or braking force of the drivetrain of a vehicle. Usable power is produced by combining the blended combustion products from the external combustion apparatus to a low pressure-gradient positive displacement motor to produce rotational power output.

It is an object of the present invention to provide a combustion apparatus which may overcome at least some of the abovementioned disadvantages, or provide a useful or commercial choice.

One aspect of the invention resides broadly in a combustion apparatus comprising a combustion vessel, an upper inlet for a lower pressure blending gas stream, a lower inlet for a higher pressure combustion gas stream and a fuel, and an outlet through which exhaust gases exit the vessel, wherein the exhaust gases are generated at least partially by the reaction of the high pressure combustion gas stream with the fuel in the vessel.

The combustion vessel may be of any suitable size, shape or configuration. For instance, the size and shape of the combustion vessel may be determined by the duty for which the combustion apparatus is intended to be used. If the combustion apparatus is intended to be used for providing a driving force for large vehicles, the combustion vessel may be necessarily larger than if the combustion apparatus is intended to be used for providing a driving force for smaller vehicles.

Preferably, the combustion vessel is fabricated so as to be able to withstand the elevated pressures and temperatures that are likely to be encountered in the combustion apparatus. Thus, one possessing ordinary skill in the art will understand that the materials used, and construction of, the combustion vessel will be selected on the basis of (among other things) their pressure and heat resistance properties.

The upper inlet may be of any suitable type or configuration. Preferably, however, the upper inlet is adapted to provide an entry for the lower pressure gas stream into the combustion vessel such that the lower pressure gas stream rotates within the combustion vessel at or adjacent an inner surface of the combustion vessel. In some embodiments of the invention, the upper inlet is adapted to provide an entry point for the first lower pressure gas stream that is tangential to the wall of the combustion vessel. In this embodiment of the invention, it is preferred that the combustion vessel is substantially cylindrical so as to provide the most suitable vessel geometry for the lower pressure gas stream to rotate within the combustion vessel at or adjacent to an inner surface of the outer wall of the vessel. In this way, the lower pressure gas stream may form a curtain or skirt of gas adjacent the inner surface of the outer wall of the vessel, thereby cooling the outer wall of the combustion vessel. In addition, a constant flow of the lower pressure gas stream through the upper inlet ensures that the regenerative cooling of the inner flow skirt of the combustion vessel occurs due to no recycling of the lower pressure blending gas stream taking place.

In a preferred embodiment of the invention, the combustion vessel may be provided with one or more walls located at the interior of the vessel. Preferably, the one or more walls are positioned so as to ensure that the lower pressure gas stream is retained adjacent the inner surface of the outer wall of the combustion vessel for at least a portion of the height of the combustion vessel.

In some embodiments of the invention, it is preferable that the upper inlet is provided in an upper portion of the combustion vessel. In these embodiments of the invention, it is preferred that the lower pressure blending gas stream that enters the combustion vessel in an upper region thereof passes along a substantial portion of the height of the vessel before it exits the vessel through the outlet. Thus, the combustion vessel may be provided with one or more diversion means adapted to divert the flow of the lower pressure blending gas stream along a substantial proportion of the height of the vessel without the lower pressure blending gas stream short-circuiting to the outlet. Any suitable diversion means may be provided to direct the lower pressure blending gas stream between the upper inlet and the outlet along a substantial portion of the height of the vessel, although it is preferred that a physical barrier to prevent short-circuiting of the blending gas stream to the outlet is employed. For instance, a wall (or similar physical barrier) may be provided inside the combustion vessel at a point above the upper inlet such that the only direction in which the blending gas stream is able to travel is downwardly in the vessel. Similarly, a wall may be provided at a point below the upper inlet if the upper inlet is located in a lower region of the vessel to ensure that the blending gas stream may travel in an upward direction only.

In embodiments of the invention in which the upper inlet is located in an upper region of the combustion vessel, and the lower pressure blending gas stream is forced to travel downwardly within the combustion vessel, it is preferred that the one or more internal walls ends at a point above the floor of the combustion vessel such that the blending gas stream may travel under the lower edge of the wall and enter a main chamber of the combustion vessel. Upon entering the main chamber of the vessel, the lower pressure blending gas stream may then flow to the outlet of the combustion vessel.

In a preferred embodiment of the invention, the higher pressure combustion gas stream and fuel entering the main chamber of the combustion chamber vessel enter through an igniter manifold located at the lower inlet of the combustion vessel. While it is envisioned that the lower inlet could be located at any suitable point within the vessel, it is preferred that the lower inlet is located in a lower region of the combustion vessel. In a particular embodiment of the invention, the lower inlet may be located in the floor of the vessel. The higher pressure combustion gas stream and fuel entering the combustion vessel through the igniter manifold located at the lower inlet may enter the vessel at any suitable angle, however it is preferred that the higher pressure combustion gas stream and fuel enter the combustion vessel and flow upwardly through the combustion vessel to the outlet. The ratio of fuel to higher pressure combustion gas stream entering the combustion vessel through the lower inlet may be constant, or may be variable. In a preferred embodiment of the invention, the ratio of fuel to a second (high pressure) combustion gas stream entering the combustion vessel through the second inlet may be varied depending on the purpose and duty of the combustion apparatus. Thus, the fuel to the second (high pressure) combustion gas stream mixture may be varied between fuel-rich, fuel-lean and stoichiometric ratios of fuel to second combustion gas stream.

The higher pressure combustion gas stream and the fuel may be combined prior to entering the vessel such that a combined fuel/higher pressure combustion gas stream enters through the lower inlet. Alternatively, the higher pressure combustion gas stream and the fuel may be combined in a passageway leading to the lower inlet using any suitable technique (such as a Venturi effect to draw the fuel into the lower inlet). In other embodiments of the invention, the lower inlet may be provided with an inlet passageway, the inlet passageway having a fuel inlet and a higher pressure combustion gas stream inlet. In this embodiment of the invention, the fuel and higher pressure combustion gas stream may be allowed to combine at any suitable point within the inlet passageway. However, in a preferred embodiment of the invention, the fuel and higher pressure combustion gas stream may only be combined at or near the point of entry into the combustion chamber. In this way, any premature reaction of the fuel and higher pressure combustion gas stream may be prevented. This may be important both from a safety point of view, and in terms of ensuring that as much energy generated by the reaction of the fuel and the higher pressure combustion gas stream is captured within the combustion vessel.

The reaction between the fuel and the higher pressure combustion gas stream may be, for instance, a naturally-occurring exothermic chemical reaction. Alternatively, the fuel and gas stream may require the input of energy in order to begin the reaction. In this embodiment of the invention, the combustion vessel may be provided with energy input device adapted to provide the required energy to start the reaction between the fuel and the higher pressure combustion gas stream. Preferably, the energy input device is located at or adjacent the lower inlet (or inside the inlet passageway, if present) such that the reaction between the fuel and the higher pressure combustion gas stream commences just as, or just prior to, entry of the higher pressure combustion gas stream and fuel into the combustion vessel through the lower inlet.

The energy input device may be of any suitable type. For instance, the energy input means may be adapted to input microwave energy, UV energy, infrared energy, heat energy, frictional energy or the like, or any combination thereof into the higher pressure combustion gas stream/fuel mixture. In a preferred embodiment of the invention, the energy input device is adapted to input heat energy into the higher pressure combustion gas stream/fuel mixture using any suitable heat source. In a most preferred embodiment of the invention, the energy input device comprises one or more burners, spark igniters (particularly electronic spark igniters) or the like, or a combination thereof.

In preferred embodiments of the invention, as the mixture of fuel and the higher pressure combustion gas stream passes the energy input device, the energy input by the energy input means causes a reaction to occur. For instance, the energy input by the energy input means may cause the fuel and higher pressure combustion gas stream mixture to combust.

In a preferred embodiment of the invention, the lower inlet is further provided with a constricted portion between the energy input device and the point at which the fuel/higher pressure combustion gas stream mixture enters the combustion vessel. Any suitable constricted portion may be provided. For instance, the constricted portion may simply be a narrowed region of the lower inlet or the inlet passageway if present. The constricted portion is adapted to increase the velocity and lower the pressure of the fuel and second (higher pressure) combustion gas stream mixture as it enters the combustion vessel.

Alternatively, the constricted portion may be in the form of one or more nozzles adapted not only to increase the velocity and pressure of the fuel/higher pressure combustion gas stream mixture as it enters the combustion vessel, but also to impart an angular flow (for instance, a swirling flow) to the fuel/higher pressure combustion gas stream mixture as it enters the combustion vessel.

Preferably, as the fuel/higher pressure combustion gas stream mixture enters the main chamber of the combustion vessel, it combines with the lower pressure blending gas stream. Additional combustion may occur in the main chamber, particularly if the fuel/second combustion gas stream mixture is fuel-rich.

It is preferred that the combined exhaust gas stream that leaves the combustion vessel through the outlet is at a controlled elevated temperature. The hot, pressurized exhaust gas stream may then be used to drive any suitable device that requires a combustion reaction as a driving force, such as a vehicle (cars, trucks, buses, agricultural machinery, boats, airplanes or the like), fixed machinery and plant equipment (for instance, that used in mining, industrial and manufacturing plants, power generation plants and the like) and so on. For instance, the exhaust gases may be provided to a low pressure-gradient positive displacement motor.

The exhaust gases may be provided directly to another device requiring a combustion reaction as a driving force, or it may first pass through a conditioning apparatus. A conditioning apparatus may be provided to condition one or more of the temperature, pressure, noise, energy, and flow characteristics of the exhaust gases in order to ensure that the exhaust gases provided to the device requiring a combustion reaction as a driving force are consistent in terms of their characteristics and flow properties.

In a preferred embodiment of the invention, the outlet may be provided at an angle tangential to the outer wall of the combustion vessel. In another preferred embodiment, the outlet may be in the form of an outlet passageway that extends outwardly from the combustion vessel, wherein the exhaust gases flow along the outlet passageway for delivery to a device for use or, for instance, to a conditioning apparatus.

In some embodiments of the invention, the combustion vessel may be provided with a pressure relief device. In this way, if the pressure inside the combustion vessel reaches a predetermined upper limit, the pressure relief device may be activated in order to reduce the pressure within the combustion vessel, thereby preventing damage to the apparatus, or an explosion, or the like. Any suitable pressure relief device may be provided, such as but not limited to, one or more seals, valves, springs or the like that is activated when the pressure reaches a predetermined level, thereby causing depressurization of the combustion vessel.

The lower pressure blending gas stream and the higher pressure combustion gas stream may comprise any suitable gas. The lower pressure blending gas stream and the higher pressure combustion gas stream may comprise the same gas, or different gases to one another. In a preferred embodiment of the invention, however, the first and second gas streams comprise the same gas. Preferably, the gas when combusted in the presence of the fuel provides an exhaust gas having a high calorific value. Thus, in some embodiments of the invention, the two combustion gas streams may be air (for instance, compressed air), oxygen or the like.

This difference in pressure between the first and second gas streams may be achieved by making use of separate gas sources (e.g. one relatively high pressure source and one relative low pressure source) or, alternatively, making use of a single gas source which is split into a high pressure storage vessel and a low pressure storage vessel, for instance by dividing the gas source so that a portion passes through a low pressure compressor and a portion passes through a second high pressure compressor.

The division of gas from the gas source between the high pressure compressor and the low pressure compressor (and subsequent driving of the high pressure compressor and the low pressure compressor) may be achieved using any suitable technique. However, in a preferred embodiment of the invention, the supply of power to the high pressure and low pressure compressors may be achieved using a drive device, such as a motor or, alternatively, a force generated by the vehicle or device being driven by the combustion apparatus, or regenerative braking to send compressed gas to a storage vessel. Preferably, the power is supplied to the high and low pressure compressors only as required. For instance, there may be periods when the combustion apparatus is used to accelerate a vehicle and the compressors are disengaged.

Any suitable fuel may be used. However, it is preferred that the fuel is an organic fuel. Thus, the fuel may be a gaseous fuel (such as methane, ethane, butane or the like), a liquid (LPG, LNG, gasoline, diesel, fuel oil, kerosene or the like) or a solid fuel (such as coal, coke, wood or the like) or any combination thereof. A skilled practitioner will understand that there may be other organic fuels which may also be suitable for use in the combustion apparatus of the present invention.

With the foregoing in view, the present invention utilizes a pressurized combustion vessel that uses three inputs and one output to operate a pressure driven device, such as a low pressure positive displacement motor. The first input is for an organic fuel or reducing agent, the second input is a higher pressure compressed oxidizer gas, namely compressed air, to react with, or combust, the organic fuel. The third input is for a stream of blending gas, namely compressed air, that is at a lower pressure then the second input to provide secondary combustion gas (oxidizer) and regenerative cooling to the outer wall of the combustion vessel by means of an inner flow skirt that channels the circumferential flow of the lower pressure blending stream inside of an annulus created between the pressurized combustion vessel and the inner flow skirt. The lower pressure blending stream of blending gas joins with the combustion gases in a central area of the pressurized combustion vessel, where, due to the directional control of the gases, have a high value of tangential velocity. The hot combustion gases continue to spin and mix as they travel along the central axis of the combustion vessel and exit the combustion vessel at the single output. The hot pressurized gas is then used to drive the pressure driven motor, such as the previously described low pressure-gradient positive displacement motor.

The source of the higher and lower pressure compressed air for the two compressed air streams are at least two air receivers that are kept pressurized by a series of at least two axial flow or screw-type compressor interconnected to a continuously variable transmission driven by the output motor or by the driving or braking force of the drivetrain of a vehicle.

An object of the present invention is to provide a camcrank system having a first camcrank drive mechanism including a free-spinning disc provided around the outer perimeter of a center disc. A drive shaft is attached to the center disc at a distance X from the center. A connecting membrane extending around a portion of the circumference of the free-spinning disc is attached to a power source and a device for adjusting the length of the connecting membrane.

A further object of the present invention provides a camcrank system with a second camcrank drive mechanism and a second connecting membrane connected to the power source.

Yet a further object of the present invention is to provide a variable speed drive mechanism including two free-spinning discs, each free-spinning disc provided around the outer perimeter of separate center discs. An input drive is attached to one of the center discs at a distance X from the center of that disc. An output drive shaft is attached to the second center disc at a distance X from the center of that disc. A connecting membrane is provided around the outer perimeter of both of the free-spinning discs, the connecting membrane provided with a device for adjusting the length of the connecting membrane, wherein the power transferred between the input and output drive shafts is varied based upon adjusting the slack of the connecting membrane.

Various configurations, modifications, and additions can be added to modify and improve the operating characteristics of this invention. For example, various computer and electronic flow controls and fixtures can be used to measure and adjust the pressures and flows according to various input or output parameters, or the placement of different clutch configurations and flow diversions and routes can be used.

DESCRIPTION OF THE PREFERRED EMBODIMENTS

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

FIG. 1 shows sectioned views of one embodiment of the device at four ninety degree increments of the 360 degree crankshaft rotational cycle, including the power portion (FIG. 1A), the top-dead-center portion (FIG. 1B), the exhaust portion (FIG. 1C), and bottom-dead-center (FIG. 1D) portion of the rotational cycle.

Figure 1A:
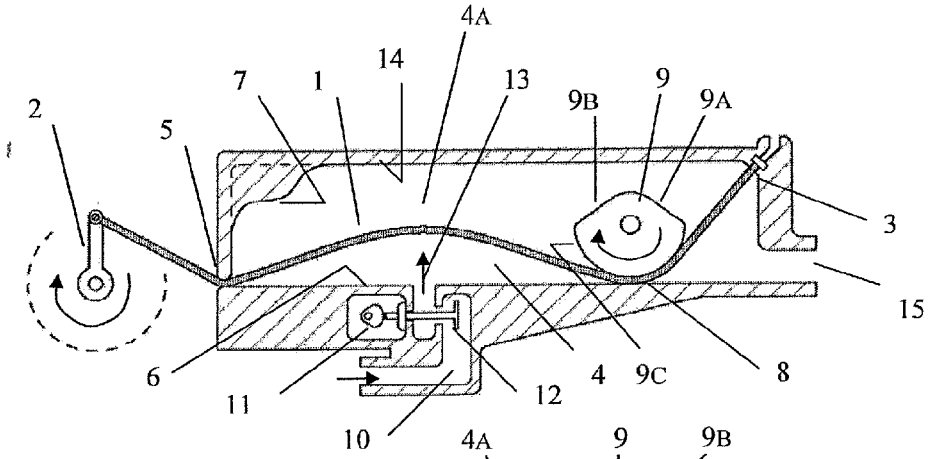
FIGS. 1A-1D show sectioned views of a pressure driven apparatus according to an embodiment of the invention during an operational sequence of the apparatus.

In reference to FIG. 1A, a flexible membrane 1 with two ends has one end attached to a crankshaft 2 (mechanical supports for the crankshaft are not shown) and the other end is attached to a fixture point 3 within a housing or crankcase 14. In between the crankshaft 2 and the fixture point 3 there is an expansion zone 4 provided within the housing created by the annulus formed between membrane 1, a front circumferential seal 5, a base plate 6, two sidewalls 7 (not fully shown in order to show internal parts), and a pinch zone 8 created by the action of an exhaust cam 9 pinching against the base plate 6.

The exhaust cam 9 is provided with three outer bearing lobe surfaces 9A, 9B and 9C. The approximate hemispheric surface 9A bears against the membrane 9A to pinch against the base plate 6 in the stroke position shown in FIG. 1A. Surfaces 9B and 9C are approximately equal to each other in length and will bear against the membrane 1 as will be further explained.

FIG. 1A shows the invention at half way through the power stroke. At this point in the rotational cycle pressurized fluid which has entered and continues to enter through a supply port 10 and is being injected into the sealed expansion zone 4 by means of an injection cam 11 opening an injection valve 12 allowing entry of pressurized fluid into the expansion zone 4 through an injection port 13. The pressurized and or expanding fluid in the expansion zone 4 pushes against the membrane 1 backed by the typically lower atmospheric pressure within the crankcase 14 in section 4A on the side of the membrane 1 opposite the expansion zone 4 and causes tension in the membrane 1 causing it to pull on the crankshaft 2. It is noted that any controlled fluid injection method could be used including electronic type, mechanical, hydraulic, or other types of electro-mechanical means of on-off fluid injection.

Figure 1B:
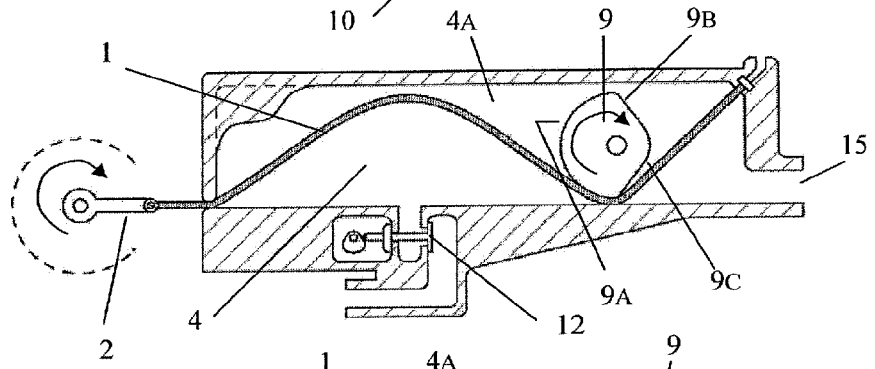

FIG. 1B shows the invention at bottom-dead-center of the crankshaft 2 stroke. The injection valve 12 is closed and the exhaust cam lobe 9 is immediately poised to allow the membrane 1 to open to depressurize the expansion zone 4 through exhaust port 15 taking some tension off of the membrane 1. FIG. 1B illustrates the lobe 9C immediately before it will abut on the main frame 1.

Figure 1C:
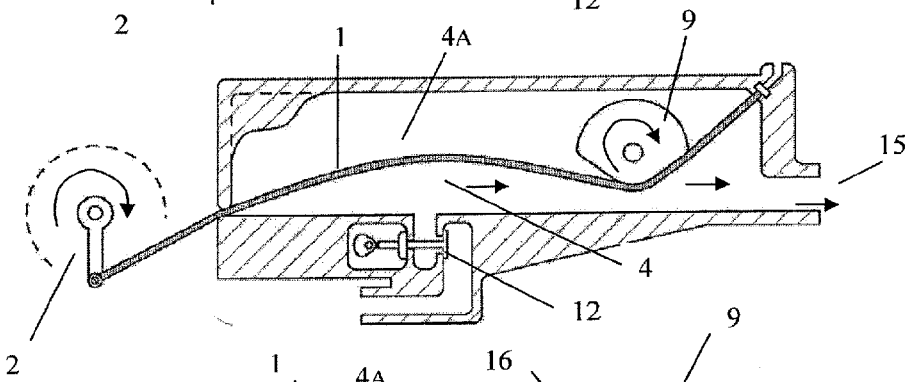

FIG. 1C shows the invention half way through the exhaust stroke section of the rotational cycle. The exhaust cam lobe 9B abuts the membrane 1 and has allowed it to rise and the expansion zone 4 is directly exposed to the exhaust port 15. As the crankshaft 2 continuous around it pulls on the membrane 1 which collapses the expansion zone 4 forcing the exhaust fluids out of the exhaust port 15 as lobe 9A begins to abut the membrane 1.

Figure 1D:
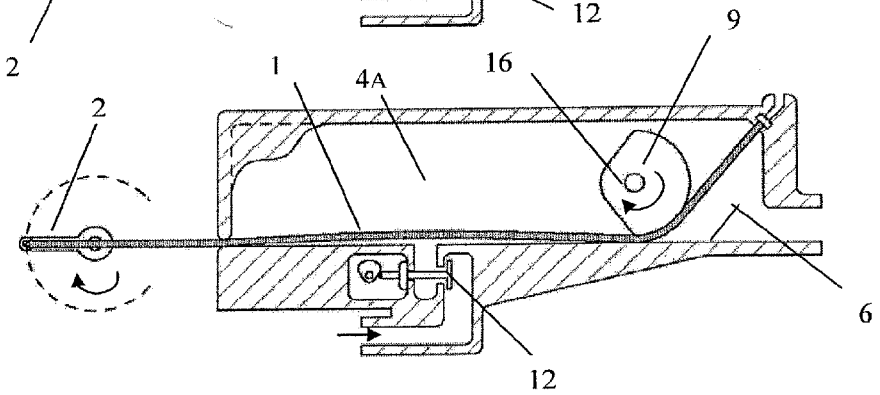

FIG. 1D shows the invention at top-dead-center of the crankshaft 2 stroke. The injection valve 12 is beginning to open to allow pressurized fluid into the expansion zone 4 to being the power stroke and the exhaust cam lobe 9, which is driven by a cam shaft 16, is beginning to pinch the membrane 1 against the base plate 6 to allow the pressurization of the expansion zone 4 and tensioning of the membrane 1 and so on and so forth into another rotational cycle. To eliminate direct contact of the exhaust cam lobe 9 against the flexible membrane 1, an intermediate tappet-like device (not shown) could be used. This intermediate tappet-like device could pivot or hinge between the exhaust cam lobe 9 and the flexible membrane 1 to lessen direct impact loads of the exhaust cam lobe 9 and the membrane 1, similar to a valve lifter that is used between the cam lobe and the intake or exhaust valve in a conventional internal combustion engine.

Figure 2:
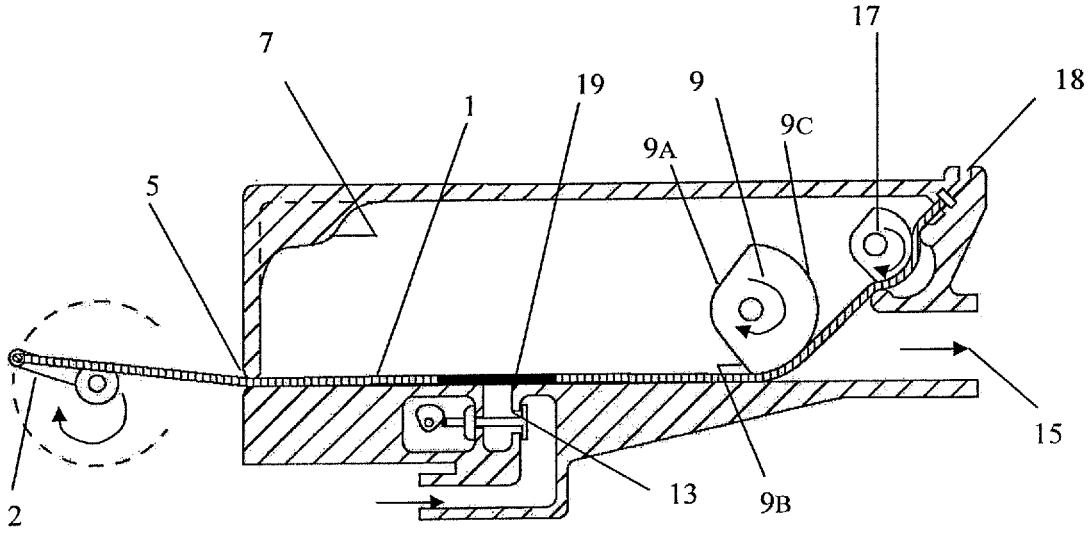
FIG. 2 shows a sectioned view of a pressure driven apparatus according to an embodiment of the invention.

FIG. 2 shows one embodiment of a sectioned view of the invention including an embodiment of an ancillary timing cam 17 installed to change the timing of the pressurized fluid injection into the power stroke of the rotational cycle. In this embodiment, the timing cam 17 is configured to take up slack in the membrane 1 when the crankshaft 2 rotates past top-dead-center. Pressurized fluid is injected after top-dead-center to cause the power stroke to occur during a region of the crankshaft 2 rotation where the tension in the membrane 1 is more tangential and has a larger component of leverage, thereby increasing torque and efficiency of the motor. It is noted that any belt tensioning method could be used to affect the slack and or timing of the membrane 1 closing or opening cycle including electronic, mechanical, hydraulic, rotational, rotating or non-rotating cam, winding spool, second crankshaft, or other types of electro-mechanical means.

The embodiment shown in FIG. 2 includes a pressure fill port 18 filled by a source of fluid, not shown, that is used to impart pressure into a hollow portion of the flexible membrane improving the sealing characteristics of the membrane, as described in more detail later in FIGS. 4 through 6. FIG. 2 also shows one embodiment including a center reinforcement area 19 of the membrane 1 where aggressive conditions caused by high fluid pressures and velocities exiting the injection port 13 can impinge and cause wear problems. The center reinforcement area 19 is constructed from material to prevent or impede wear problems from occurring.

It is noted that the embodiment shown in FIG. 2 can be configured to change the stroke height of the flexible membrane 1 in the expansion zone 4. For example, there are two stroke lengths associated with this invention including L1, the stroke length of the rotating crankshaft 2, and, L2 the maximum height that the flexible membrane 1 achieves when the rotational cycle is at bottom dead center of the rotational cycle (FIG. 1B). It is further noted that the stroke length L2 can be changed by moving the front circumferential seal 5 location forward and back from the crankshaft 2 center and the cam 9 location. This allows for performance and output characteristic of the invention to be changed, either in a fixed method or on-the-fly. In general it is desirable to have L2 longer that L1. With L2 longer than L1 there are benefits associated with the higher hoop stress, or tension, over a longer stroke of flexible membrane 1. Where in this example hoop stress is described as σ (hoop stress or tension, psi)=P (fluid pressure in the expansion zone 4, psi)×r (radius or arc, inches) divided by t (thickness of the membrane, inches), further shown in mathematical form as:

$$\text{Tension in Band} = \text{pressure} \times \text{radius}/\text{thickness} = \text{Hoop Stress}$$

Using mathematical rules to convert the above equation in the value for force (lbs) produced by the flexible membrane 1 on the crankshaft 2 we have the following equation:

$$\text{Force Exerted by Band} = \text{pressure} \times \text{radius} \times \text{width}.$$

Another description of the tension in the membrane is defined in terms of beam loading mechanics where the force of the pressure is compounded by the beam loading placement toward the middle of L2, where F (force or tension on the membrane is a function of the P (fluid pressure in the expansion zone 4) multiplied by the inverse of sin ø (where ø is generally the angle between the membrane and the horizontal base plate 6).

Again, referring to FIG. 2, it is also noted that the power stroke and exhaust stroke timing characteristics can be changed by offsetting the main journal of crankshaft 2 either up or down from the plane of the of the horizontal base plate 6.

Figure 3A:
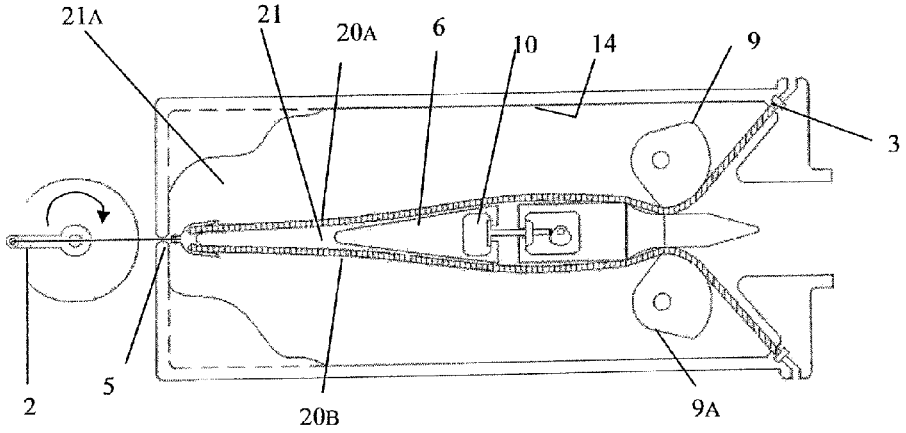
FIGS. 3A-3C show sectioned views of a pressure driven apparatus according to an alternative embodiment of the invention during an operational sequence of the apparatus.
Figure 3B:
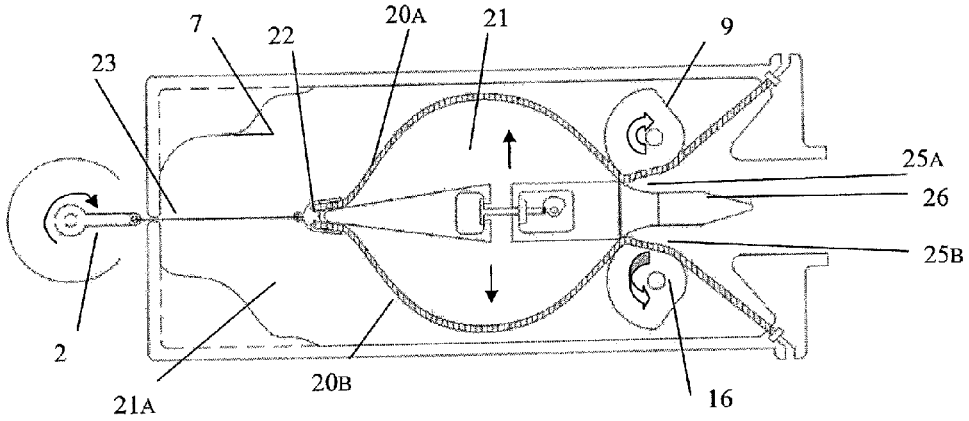
Figure 3C:
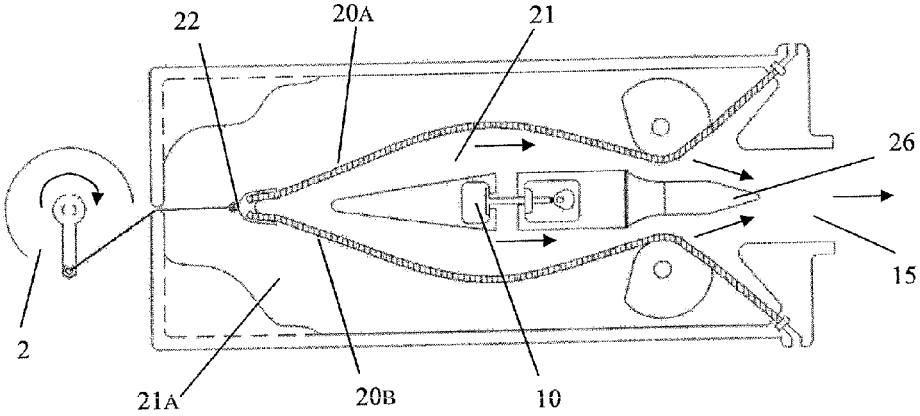

FIG. 3 shows sectioned views of a preferred embodiment of the invention where two opposing membranes 20A and 20B create a continuous double expansion zone 21 between members 20A and 20B. Three regions of the crankshaft 2 rotation are shown, including top-dead-center (FIG. 3A), bottom-dead-center (FIG. 3B), and a point of rotation half way through the exhaust stroke (FIG. 3C).

The principal of operation of the embodiment shown in FIG. 3 is basically the same as that shown in FIG. 1. As shown in FIG. 3A and FIG. 3B, the two opposing membranes 20A and 20B are joined together at a travelling yoke 22 assembly that maintains a dynamic leak free seal between the pressurized double expansion zone 21 and the non-pressurized and vented zone in the crankcase 14 outside of the double expansion zone 21. A flexible connecting membrane 23 is connected between the crankshaft 2 and the travelling yoke 22. The tension on the connecting membrane 23 is double the tension on the opposing membranes 20A and 20B. The connecting membrane 23 can be routed to the crankshaft circuitously through a series of cables and pulleys. The configuration of the two opposing membranes 20A and 20B has inherent balancing benefits, where the acceleration and deceleration forces caused by the up and down components of motion cancel each other out.

In the embodiment shown in FIG. 3, and partially shown in FIG. 3B, a first offset area 25A is provided between an exhaust tailpipe 26 and membrane 20A, and a second offset area 25B provided between the exhaust tail pipe 26 and the membrane 20B. The offset area 25A coincides with the cam 9, and the offset area 25B coincides with a second cam 9A. The offset areas 25A and 25B affect the timing of the injection of the pressurized fluid beyond the top-dead-center point of the crankshaft rotation, similar to the timing cam 17 shown in FIG. 2. The placement of the offset areas 25A and 25B and the length of the lobes on cams 9 and 9A can be configured to create many different injection and exhaust timing scenarios. As shown in FIG. 3B, the cams 9 and 9A rotate in opposite directions as depicted by the arrows associated with each of the cams 9 and 9A.

FIG. 3C shows one embodiment of the placement of the aerodynamically shaped exhaust tail 26 in the exhaust port 15 that produces a lower flow resistance of the exhaust fluids. In the embodiment shown, the high pressure supply inlet port 10 enters from the side of the base plate 6. It is noted that the base plate 6 can be simplified and omitted entirely with the configuration of two opposing membranes 20A and 20B. The sealing action of the cam 16 can occur with no base plate by the cams 9 and 16 pressing and pinching the opposing flexible membranes 1 together. With no base plate 6, the supply inlet port 10 can be configured to enter adjacent or through the exhaust tail 26.

Figure 4:
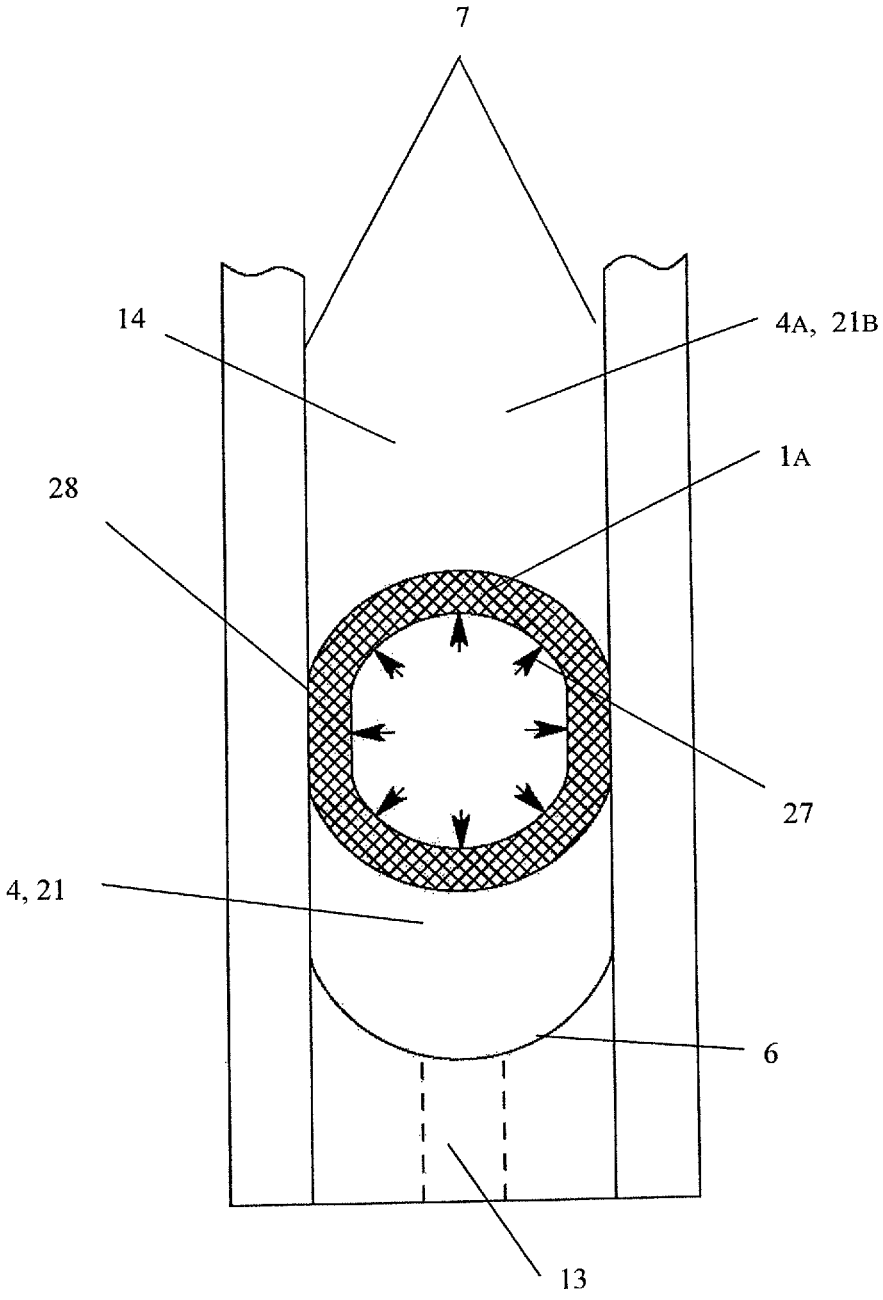
FIG. 4 shows a cross sectional view of a flexible membrane in tubular form according to an embodiment of the invention.

FIG. 4 shows a cross section view of one embodiment of the sealing characteristics of a tubular membrane 1 against the sidewalls 7 of the expansion zone (4 or 21), and the base plate 6. In this embodiment, pressure injected into the tubular membrane 1A causes a radial sealing force 27 to cause a plastically formed sealing area 28 between the pressurized expansion zone (4 or 21) and the non-pressurized crankcase area 14. The sealing area 28 can be augmented with the use of molded shapes, groves, o-rings, and or sealing inserts. This sealing area 28 would be comprised with materials that produce the lowest possible coefficient of friction. It is noted here that the flexible membrane 1A can be configured to have a dispersement of reinforcement, such as metal or high strength non-metallic cords, strips, ropes, roves, corrugated or crinkled materials, sandwich structures, bonded multi-layered material, unbonded multi-layered material (allowing slippage between layers), nanomaterials, cables or wires, to increase the tensile strength and elastic modulus of the flexible membrane 1A.

Figure 5:
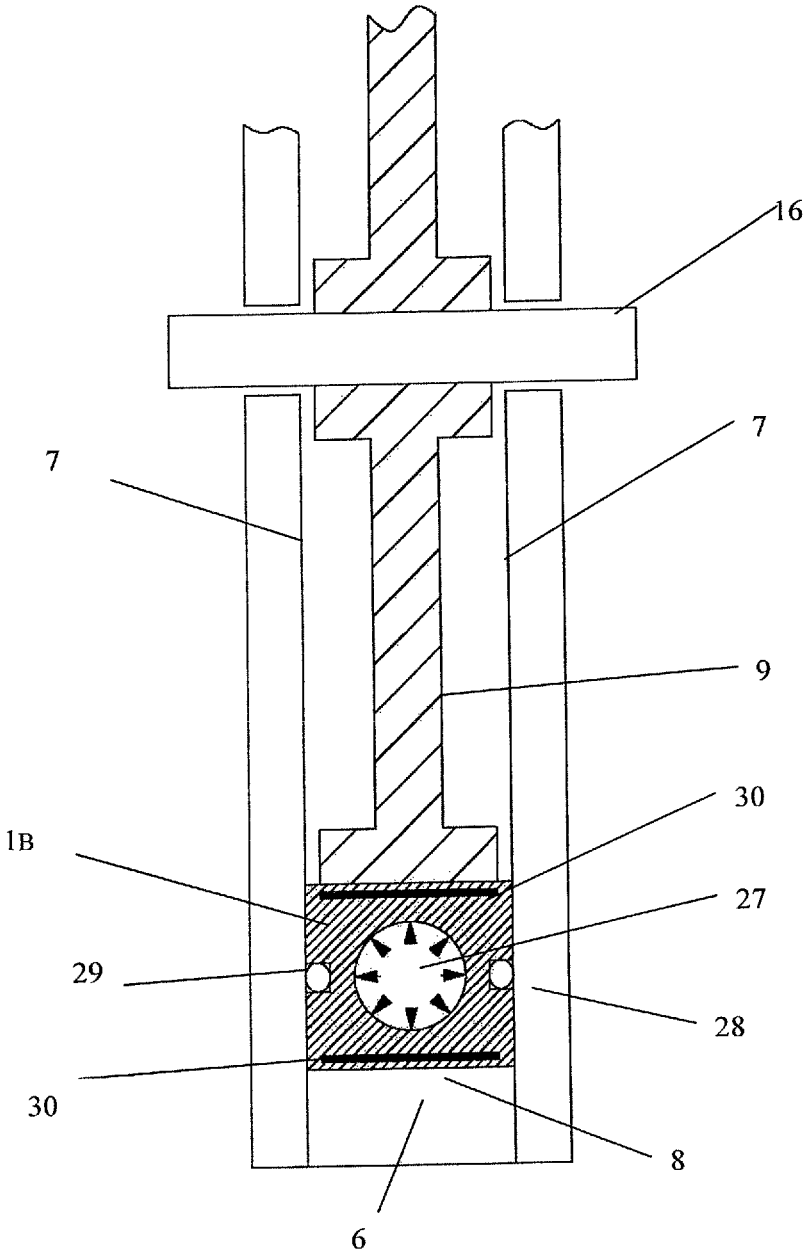
FIG. 5 shows a cross sectional view of a flexible membrane and a timing exhaust cam according to an embodiment of the invention.

FIG. 5 shows a cross section view of one embodiment of the exhaust cam 9 creating a seal between a rectangular shaped membrane 1B, the sidewalls 7, and the base plate 6 at the pinching zone 8. In this embodiment, forces from both the exhaust cam 9 and the sealing force 27 from pressure injected into a hollow section of the rectangular shaped membrane 1B together cause a plastically formed sealing area 28. In this embodiment the rectangular shaped flexible membrane 1B has an o-ring type sealing mechanism 29, and has steel band reinforcement 30 molded into and/or mechanically bonded and mounted onto the flexible membrane 1B. The sidewalls 7 are preferably a low friction material with desirable heat transfer characteristics and could include ceramics, oxides of titanium, oxides of aluminium, composites, composites with base matrixes of inclusions of silicon or carbon, or any suitable material including nanotechnology materials. In this embodiment the area of the exhaust cam 9 is openly exposed toward the housing or crankcase 14 (not shown) and can be splash lubricated or pressure lubricated through oil pumped from the camshaft 16.

Figure 6:
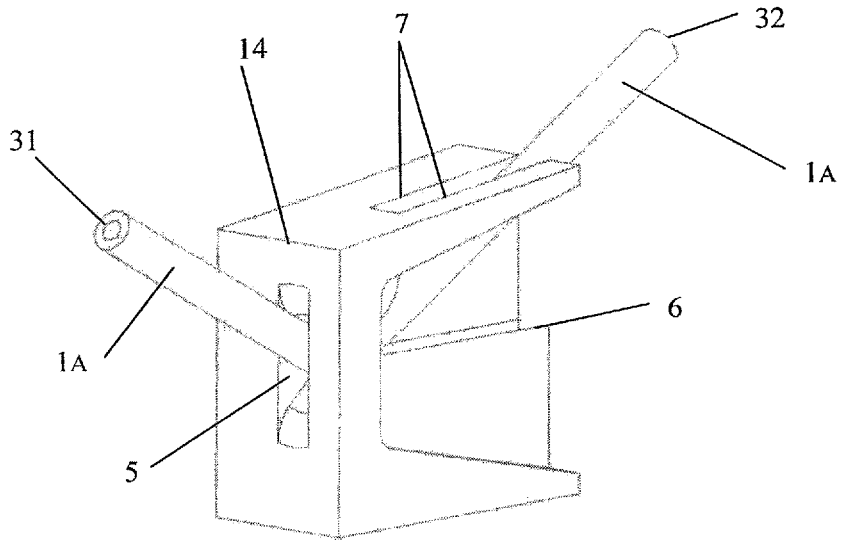
FIG. 6 shows a perspective view a pressure driven apparatus according to an embodiment of the invention.

FIG. 6 shows a three dimensional cut-away view from the crankshaft side of one embodiment of a pressure tight dynamic circumferential seal 5 made between the head plate of the housing or crankcase 14 and a tubular shaped flexible membrane 1A. This seal is referenced in the description of FIG. 1. In this embodiment a front circumferential seal 5 is made though the housing or crankcase 14 allowing the required back and forth movement of the tubular membrane 1A to transfer force to the crankshaft 2, while maintaining a pressure tight seal between the non-pressurized crankcase area 4A and the pressurized expansion zone 4. Also shown in FIG. 6 are the side walls 7, the base plate 6, the crankshaft end 31 of the tubular membrane going to the crankshaft 2 (not shown), and the fixture end 32 of the tubular membrane going toward the fixture end 3 (not shown). In this embodiment the tubular membrane 1 is pressurized to enhance the sealing characteristics of the dynamic front circumferential seal 5.

Figure 7:
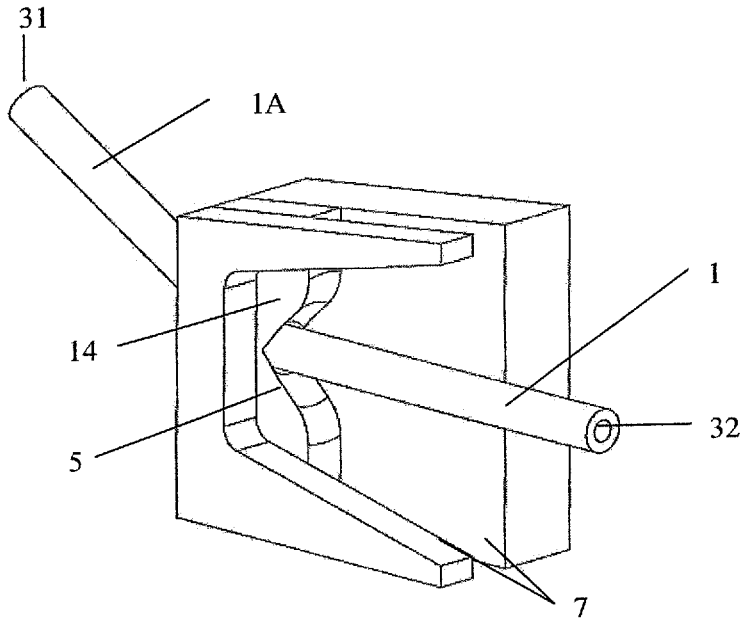
FIG. 7 shows a perspective view a pressure driven apparatus according to an embodiment of the invention.

FIG. 7 is a three dimensional view of one embodiment of a pressure tight dynamic seal 5 made between the head plate of the crankcase 14 and a tubular shaped flexible membrane 1 as viewed from the from the flexible membrane 1 side of the head plate part of the crankcase 14. Also shown in FIG. 7 are the side walls 7, the crankshaft end 31 of the tubular membrane going to the crankshaft 2 (not shown), and the fixture end 32 of the tubular membrane going toward the fixture point 3 (not shown). In this embodiment the tubular membrane 1A is pressurized to enhance the sealing characteristics of the dynamic front circumferential seal 5.

Figure 8A:
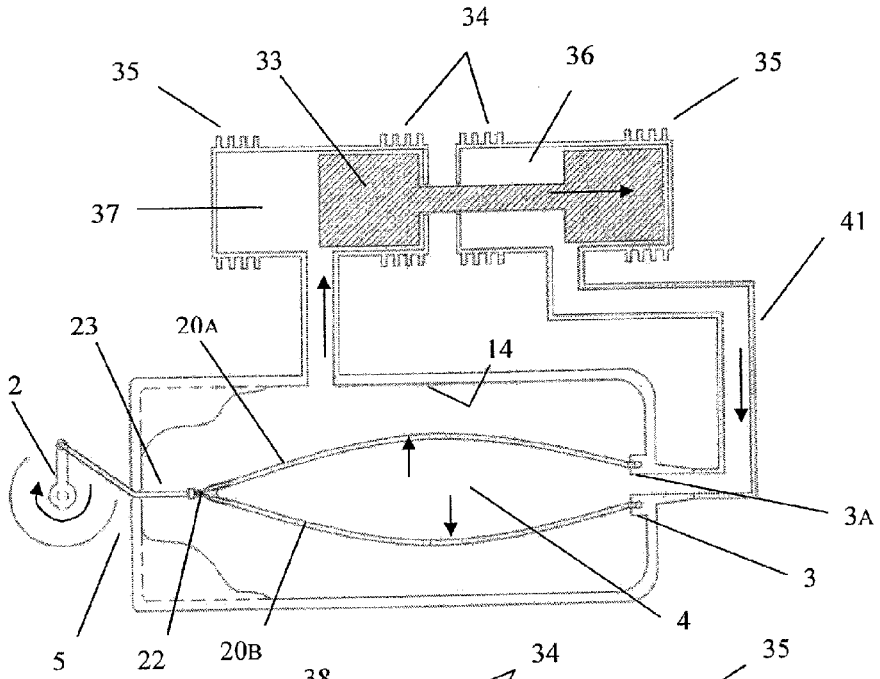
FIGS. 8A-8B show sectioned views of a pressure driven apparatus according to an embodiment of the present invention during an operational sequence of the apparatus.
Figure 8B:
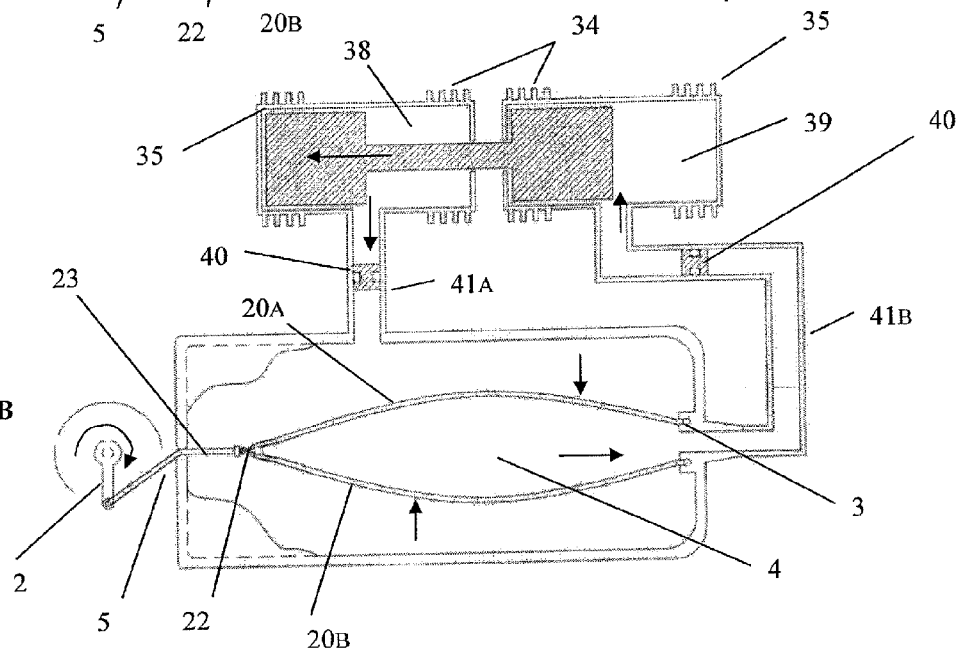

FIGS. 8A and 8B show sectioned views of one embodiment of the invention with two opposing membranes 20A and 20B fixed at one end by fixture points 3 and at the second end to a yoke 22 assembly, then to a tubular flexible connecting membrane 23 and then to the crankshaft 2 through a dynamic circumferential seal 5. In this embodiment the source of the pressure differential is a thermal gradient caused by a type of Stirling engine, where a displacement piston 33 moves gas back and forth between hot sections 34 and cold sections 35, creating expansion and contraction to and from the described invention by way of pressure carrying conduits 41 in a cyclical fashion that corresponds to the power and return cycle of the crankshaft 2.

FIG. 8A shows one embodiment of the motor in the power stroke of the cycle where heat input from the hot section 34 causes the gas in a hot end chamber 36 to expand causing forced expansion of the expansion zone 4 side of the flexible membranes 20A and 20B, while cooling in a cold end chamber 37 is contracting the gas on the crankcase 14 side of the membrane, where both the expansion and contracting actions of the gas cause the tension on the flexible membrane 20A and 20B and torque on the crankshaft 2.

FIG. 8B shows one embodiment of the motor in the return stroke, or nonpower stroke, where heat input from the hot section 34 causes the gas in a second hot end chamber 38 to expand causing forced expansion of the crankcase 14 side of the membrane, while cooling in the second cold end chamber 39 is contracting the gas on the expansion zone 4 side of the membrane, resulting in less energy required to collapse the expansion zone 4 then used on the power stroke. More energy exerting tension on the membrane 20 and 20B during the power stroke than on the return stoke results in a net output of energy through the crankshaft rotation.

FIG. 8B shows one embodiment where separator diaphragms 40 arc configured in conduit circuits 41A and 41B that allow for the separation of fluid from the gas filled Stirling type of engine from the fluid in the crankcase 14 and the expansion zone 4. The use of the separator diaphrams 40 enables the use of separate gases, lubrication oils, or one hundred percent liquid media within the crankcase 14 and expansion zone 4. FIG. 8B shows an embodiment of a tubular flexible connecting membrane 23 that connects the yoke 22 to the crankshaft 2 through a dynamic circumferential seal 5. It is noted that a cam could be configured into a flow-through design where instead of in-and-out flow the fluid is circulated or pumped in one conduit and out another.

Figure 9:
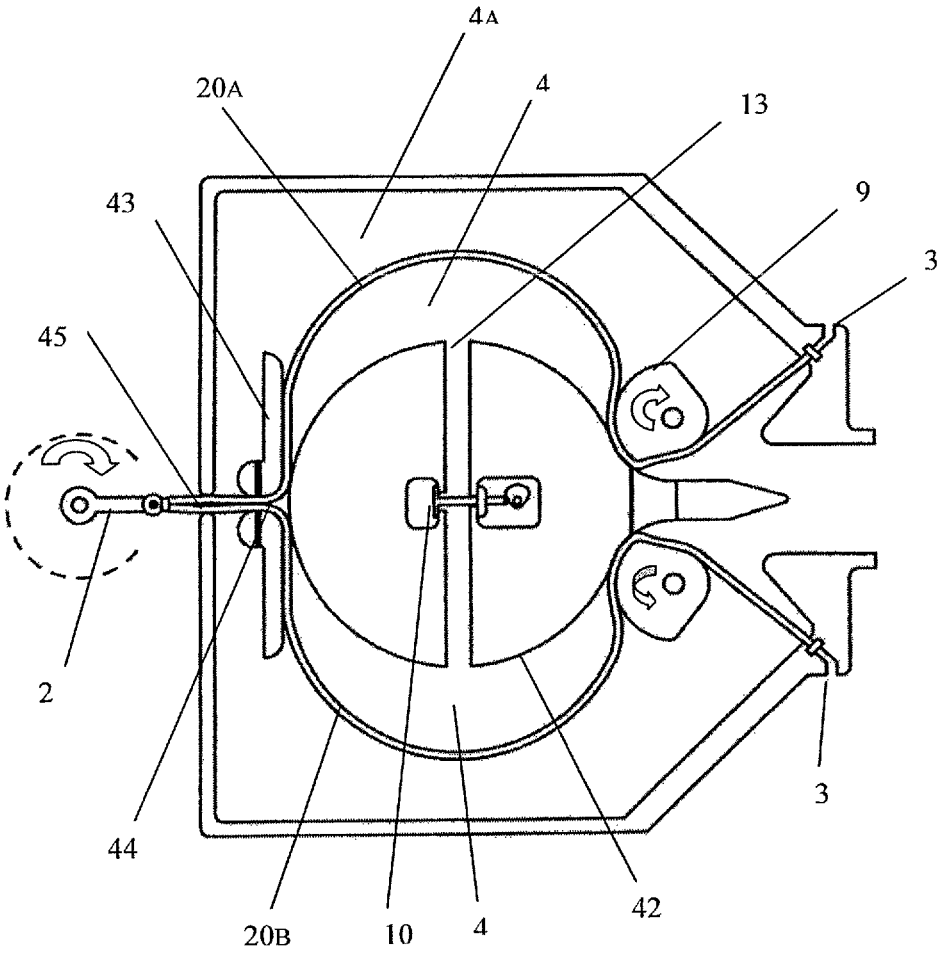
FIG. 9 shows a sectioned view of a pressure driven apparatus according to an embodiment of the invention.

FIG. 9 shows a sectioned view of one embodiment of the invention configured with two opposing membranes 20A and 20B each fixed at one end by fixture points 3 and at the other directly to the crankshaft 2. In this embodiment, the invention in configured with a circular base plate 42 and a band guide 43. At the intersection of the opposing flexible membranes 20A and 20B, the band guide 43 forces the two flexible membranes 20A and 20B together to form a dynamic band guide seal 44. The dynamic band guide seal 44 prevents pressurized fluid from the expansion zone 4 from escaping during the operation of the invention. Toward the crankshaft 2 side of the dynamic band seal 44, the flexible membranes 1 are joined or wrapped around the journal of the crankshaft 2. An optional non-sealing band guide 45 is shown between the crankshaft 2 and the band guide seal 44.

FIG. 9 shows the use of the circular base plate 42 with a supply port 10 and inlet ports 13 directed to each expansion zone 4. The configuration of a circular base plate 42 has the effect of a block and pulley type of motion reduction, where the distance pulled by the crankshaft 2 results in generally one-half the distance moving at the top of the each of the flexible membranes. This configuration results in less tension on the flexible membranes 20A and 20B than the configurations shown in FIGS. 1 through 3. It is noted that numerous valving or fluid supply mechanism could be used instead of the supply port 10 and inlet port 13 configuration, including push-pull valves, rotating valves, diaphragms, or push-pull or rotating cylinder style valves.

Figure 10A:
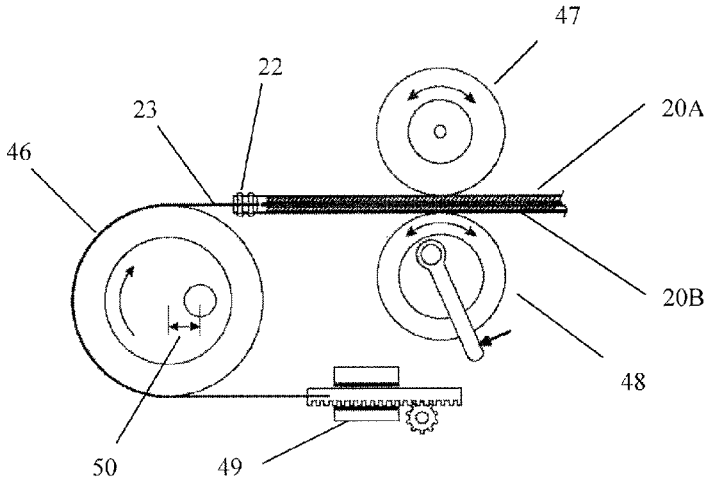
FIGS. 10A-10C show sectioned views of a crankshaft alternative embodiment comprising a camcrank for use with the pressure driven apparatus illustrating an operational sequence of the apparatus.
Figure 10B:
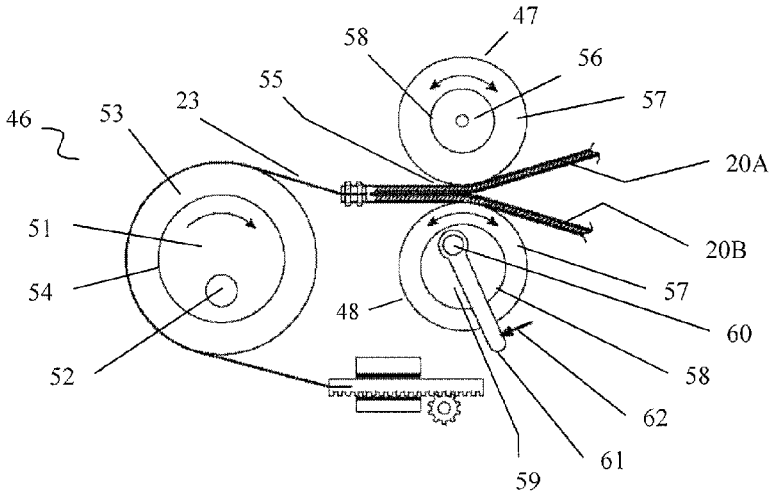
Figure 10C:
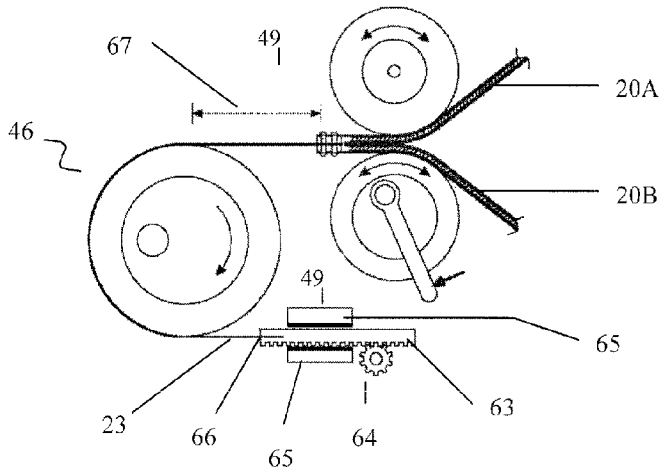

FIGS. 10A, 10B, and 10C show sectioned views of an alternative embodiment of the invention in various positions of the rotational cycle wherein two opposing membranes 20A and 20B apply force to a form of crankshaft alternative comprised of a camcrank assembly 46 for the development of rotational torque and power output. For a detailed description of the positions of the rotational cycle see drawings and descriptions of FIGS. 1, 2 and 3. FIG. 10A shows the camcrank assembly 46 at top-dead-center (see FIG. 3A). FIG. 10B shows the camcrank assembly 46 at halfway through the power stroke (see FIG. 3C). FIG. 10C shows the camcrank assembly 46 at bottom-dead-center (see FIG. 3B).

FIGS. 10A, 10B and 10C show an embodiment including a camcrank assembly 46, a stationary idler 47, a pivoting idler 48, a movable membrane block 49, a travelling yoke 22, a connecting membrane 23, and the two opposing membranes 20A and 20B. A drive shaft 52 is provided at an offset distance 50 from the center of the camcrank assembly 46. The two opposing membranes 20A and 20B are spliced to the connecting membrane 23 that transmits tension forces from the two opposing membranes 20A and 20B across the defined offset distance 50, producing rotational power and torque output to the camcrank assembly 46, as will be subsequently described. In an embodiment of the camcrank assembly 46 design, the connecting membrane 23 is not fixably engaged with the camcrank assembly 46, but rather the connecting membrane 23 only engages the camcrank assembly 46 if there is a tension in the two opposing membranes 20A and 20B to cause the connecting membrane 23 to move.

Reference is made to FIG. 10B for a detailed description of the camcrank assembly 46. The camcrank assembly 46 includes a round center disc 51 with the offset driveshaft 52 mounted a defined offset distance 50 (see FIG. 10A) from the center of the center disc 51. A free-spinning disc 53 is installed around the outer perimeter of the center disc 51. A bearing surface 54 is provided between the outer diameter of the center disc 51 and the inner diameter of the free-spinning disc 53 to allow full free rotation of the free-spinning disc 53 relative to the round center disc 51. The purpose of the free-spinning disc 53 is to allow unimpeded motion of the connecting membrane 23 around the free-spinning disc 53 relative to the round center disc 51 when force and motion are transmitted from the two opposing membranes 20A and 20B to the connecting membrane 23. The bearing surface 54 could utilize any type of bearing material, including, but not limited to ball, roller, tapper, needle type, babbit, white metal, or bushing material, and could include permanent or full pressure lubrication (not shown).

Reference to FIG. 10B is made for a detailed description of the stationary idler 47 and the pivoting idler 48 assemblies. The primary purpose of the stationary idler 47 and the pivoting idler 48 assemblies is to produce a dynamic seal by means of a pinch zone 55 between the two opposing membranes 20A and 20B so that no pressurized fluid can escape through the pinch zone 55 (see similar description of the purpose of the "pinch zone 8" from the FIG. 1 basic description of the invention, and throughout the description of this invention). The stationary idler assembly 47 is comprised of a circular fixed center 56, and a free-spinning outer ring 57, with a bearing material 58 mounted inbetween the circular fixed center 56 and the free-spinning outer ring 57. The pivoting idler assembly 48 is comprised of a circular pivotable center 59, and a free-spinning outer ring 57, with a bearing material 58 mounted in between the said circular pivotable center 59, and the free-spinning outer ring 57. The mechanism for pivoting the pivotable center 59 is an offset shaft 60 mounted to a shaft lever 61. When a force 62 is applied to the shaft lever 61 the offset shaft 60 turns. The offset shaft 60 is fixed to the pivotable center 59, therefore causing the entire pivoting idler assembly 48 to rotate into the stationary idler assembly 47, thereby causing the pinch zone 55 necessary for a dynamic seal. The force creating the pinch zone 55 can be adjusted by the amount of force 62 applied to the shaft lever 61. This force 62 can be created by any common device, such as springs, hydraulics, pneumatics, or threads. The purpose of the free-spinning outer ring 57 is to allow the unimpeded movement of the two opposing membranes 20A and 20B as they transmit force and motion to the camcrank assembly 46. It should also be noted that all bearing surfaces 58 can be continuously pressure lubricated with engine oil during operation of the invention.

Reference to FIG. 10C is made for a detailed description of the movable membrane block 49. The movable membrane block 49 allows for the dynamic adjustment of the effective length of the connecting membrane 23. The movable membrane block 49 is comprised of a geared linear shaft 63, a round gear 64, a holding block 65, and a connection point 66. In this embodiment, the length of the connecting membrane 23 is adjusted by the turning of the round gear 64, which moves the geared linear shaft 63 that is secured within the confines of the holding block 65 for motion in the one axis, the movement of the geared linear shaft 63 then adds or subtracts from the effective length of connecting membrane 23 through the use of a connection point 66. There are numerous reasons and advantages to make adjustments to the length of the connecting membrane 23. Some of these include tension adjustments, power stroke timing (see explanation of timing cam 17, see FIG. 2), and a free-spin option where full slack could be let out such that the rotating camcrank assembly 46 avoids making contact with the connecting membrane 23. It is further noted that there would be numerous methods to dynamically change the effective length of the connecting membrane 23 during operation of the invention by using various configurations of hydraulics, pneumatics, gears, electronically controlled AC or DC motors, and either fixed or variable cam mechanisms.

As previously described, the offset distance 50 produces rotational power and torque output to the camcrank assembly 46. The offset distance 50 is defined as the distance from the center of the center disc 51 to the center of the offset driveshaft 52. This offset distance 50 is similar to the stroke distance, or stroke length, of a conventional piston, rod, and crankshaft journal configuration with several differences. The first and foremost difference is a multiplier factor. For example, with a conventional crankshaft configuration the length of the crankshaft journal is doubled to obtain the stroke length. For example, a crankshaft with a journal length of two inches would have a stroke of four inches (2×2=4). However, with the camcrank assembly 46 of the present invention to obtain the stroke length, the offset distance 50 is quadrupled. Therefore, an offset distance 50 of two inches would result in a stroke length of eight inches (2×4=8). This quadrupled factor is illustrated in FIG. 10C with the inclusion of a stroke length distance 67, showing the stroke length to be quadruple the value of the offset distance 50 shown in FIG. 10A. This produces great benefits in terms of making power systems more compact.

There may be several ways to analyze and prove the fact that the camcrank assembly 46 produces a quadrupled factor of the offset distance 50 to calculate the stroke length. For simplification, we will attribute this phenomenon to the fact that the camcrank assembly 46 has a simple pulley effect in multiplying the stroke-length where the rotation of the camcrank assembly 46 includes the normal stroke length associated with a conventional crankshaft journal plus the stroke length associated with the movement of the connecting membrane 23 on each of the two sides of the free-spinning outer disc 53.

Another phenomenon associated with the pulley effect of the camcrank assembly 46 is the two time multiplication of force applied from the connecting membrane 23 to the camcrank assembly 46. For example, if there is 1,000 lbs of tension in the connecting membrane 23, then there would be 2,000 lbs. of force applied to the offset point producing torque to the offset driveshaft 52. This can be verified and proven with loading analysis of a single pulley system where the load of the pulley is twice the tension in the rope. However, when compared with a conventional crankshaft type configuration with the same stroke-length, there is no net benefit because with one-half of the offset distance 50 to achieve the same stroke-length, the doubling of the force acting on the offset point produces the same torque as a conventional crankshaft type configuration. For example, a conventional crankshaft type configuration with a two inch crank journal and an 1,000 lb. load applied would produce a maximum torque of 2,000 in-lbs. (torque=force×distance=1,000×2 inches). This is compared to the camcrank assembly 46 of the present invention, wherein the 1,000 lb. load would produce a force of 2,000 lbs. across an offset distance 50 of one inch (for a four inch stroke), therefore, a maximum torque again equal to 2,000 in-lbs.

There are great benefits to camcrank assembly 46 over the conventional crankshaft configurations. Some of these benefits include but are not limited to more compact power systems, easier manufacturing, lighter weight construction, more material and manufacturing options, easier balancing of rotational components, modular designs, and inherent free-spin capability.

FIG. 10D through 10I show sectioned views of alternative embodiments of a camcrank system in accordance with the present invention. The disclosed camcrank systems include a push-pull drive mechanism and non-friction variable speed transmission.

Figure 10D:
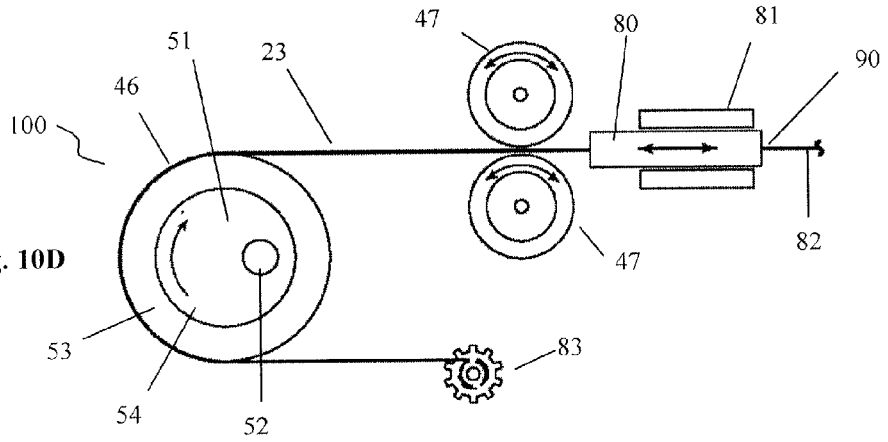
FIG. 10D shows a sectional view of a camcrank journal-less crankshaft alternative embodiment applied to a push-pull drive mechanism.

FIG. 10D shows is camcrank drive system 100 that is similar in application to the camcrank system shown with reference to FIGS. 10A, 10B and 10C, where the connecting membrane 23 is loosely engaged to the free-spinning disc 53, but with a push-pull mechanism 80. As such, the camcrank drive system 100 includes a camcrank assembly 46, stationary idlers 47, a push-pull mechanism 80, a connecting membrane 23, and a membrane coiling mechanism 83.

As with the embodiment disclosed with reference to FIGS. 10A, 10B and 10C, a drive shaft 52 is provided at an offset distance 50 from the center of the camcrank assembly 46. The push-pull mechanism 80 is connected to the connecting membrane 23 that transmits tension forces from the push-pull mechanism 80, producing rotational power and torque output to the camcrank assembly 46.

The camcrank assembly 46 includes a round center disc 51 with the offset driveshaft 52 mounted a defined offset distance 50 (see FIG. 10A) from the center of the center disc 51. A free-spinning disc 53 is installed around the outer perimeter of the center disc 51. A bearing surface 54 is provided between the outer diameter of the center disc 51 and the inner diameter of the free-spinning disc 53 to allow full free rotation of the free-spinning disc 53 relative to the round center disc 51. The purpose of the free-spinning disc 53 is to allow unimpeded motion of the connecting membrane 23 around the free-spinning disc 53 relative to the round center disc 51 when force and motion are transmitted from the push-pull mechanism 80 to the connecting membrane 23. The bearing surface 54 could utilize any type of bearing material, including, but not limited to ball, roller, tapper, needle type, babbit, white metal, or bushing material, and could include permanent or full pressure lubrication (not shown).

The push-pull mechanism 80 is in the form of an electromagnetic drive, a hydraulic drive, or any power source capable of producing a pushing and/or pulling force. The push-pull mechanism 80 is held in position by a fixed or movable push-pull base 81. In the embodiment shown in FIG. 10D, a coupling membrane 82 is connected to the end 90 of the push-pull mechanism 80 opposite the camcrank assembly 46. The coupling membrane 82 is used to attach the push-pull mechanism 80 to a second camcrank assembly (shown in FIG. 10F), typically rotating at 180 degrees opposite the camcrank assembly 46 in order to allow the push-pull mechanism 80 to provide a pulling force to the second camcrank assembly 46' (more fully shown in FIG. 10F).

In the embodiment shown in FIG. 10D a membrane coiling mechanism 83 is provided to affect the tension, length, and timing of the connecting membrane 23, much in the same way as the movable membrane block 49 shown in FIG. 10A. The membrane coiling mechanism 83 adjusts the slack, or length, in the connecting membrane 23 by rolling it into a coil.

Figure 10E:
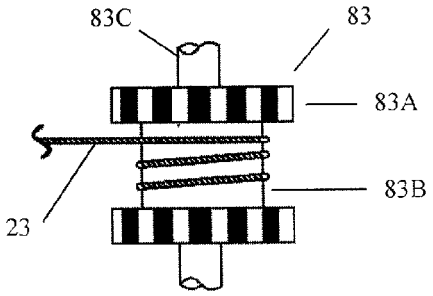
FIG. 10E shows a top view of a coil mechanism used to adjust the slack and tension of the flexible drive membrane.

FIG. 10E shows a top view of the membrane coiling mechanism 83. The membrane coiling mechanism 83 includes a coiling gear 83A for engaging the coiling mechanism 83 to a mechanism for causing rotation such as a mechanical cam or gear activated device (not shown) or an electro or hydraulically activated device, such as a step motor (not shown). FIG. 10E also shows the coiling recession 83B which provides the area for coiling the connecting membrane 23 into a coil, and the coil gear mounting shaft 83C.

Figure 10F:
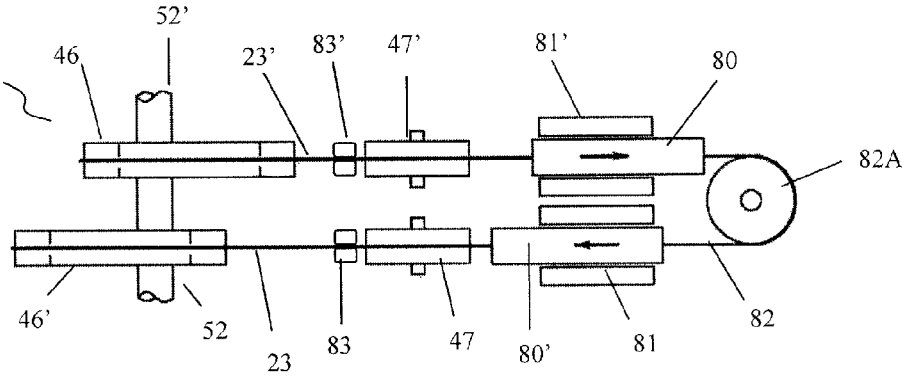
FIG. 10F shows a top view of the camcrank journal-less crankshaft linked with adjacent assembly with coupling.

FIG. 10F shows a top view of an embodiment of a camcrank drive system ## in accordance with the concepts disclosed with reference to FIG. 10D. In accordance with this embodiment, the camcrank drive system 102 includes first and second camcrank assemblies 46, 46' mounted adjacent to, and incorporating the same offset drive shaft 52. The two adjacent camcrank assemblies 46, 46' are 180 degrees out of phase, and coupled together using the coupling membrane 82 and a coupling idler gear 82A. The camcrank drive system 102 also includes first and second push-pull mechanism 80, 80'. With the camcrank assemblies 46, 46' coupled at 180 degrees out of phase with each other, the two push-pull mechanisms 80, 80' are synchronized to combine forces in putting tension into the connecting membranes 23, 23' and producing rotational power at the offset drive shaft 52. It is appreciated there could be any practical number of camcrank assemblies coupled together in a rotational sequence of 360 degrees divided by the number of camcrank assemblies, to provide smooth rotation output power coming out of the offset drive shaft.

More particular, the camcrank drive system 102 disclosed with reference to FIG. 10F includes a first and second camcrank assemblies 46, 46', first and second stationary idlers 47, 47', first and second push-pull mechanisms 80, 80', first and second connecting membranes 23, 23' and first and second membrane coiling mechanisms 83, 83'. The first camcrank assembly 46, first stationary idler 47, first push-pull mechanism 80, first connecting membrane 23 and first membrane coiling mechanisms 83 are connected to the identical (but 180 degrees out of phase) second camcrank assembly 46', second stationary idler 47', second push-pull mechanism 80', second connecting membrane 23' and second membrane coiling mechanisms 83' by a coupling membrane 82 connected to the respective ends 90, 90' of the first and second push-pull mechanisms 80, 80' opposite the first and second camcrank assemblies 46, 46'. The coupling membrane 82 passes over the coupling idler gear 82A to attach the first and second push-pull mechanisms 80, 80' order to allow the first and second push-pull mechanisms 80, 80' to work in conjunction to provide a pulling and pushing forces to the first and second camcrank assemblies 46, 46'.

It is appreciated the drive shaft 52 and camcrank assemblies 46, 46' are the same as those disclosed above with reference to FIGS. 10A, 10B and 10C, while the first and second connecting membranes 23, 23', the first and second membrane coiling mechanisms 83, 83' and the first and second stationary idlers 47, 47' are the same as that disclosed with reference to FIG. 10D.

Figure 10G:
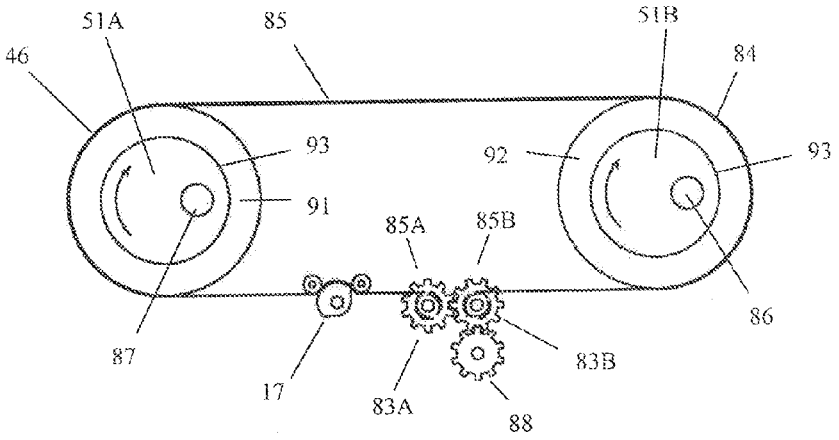
FIG. 10G shows a sectional view of a camcrank journal-less crankshaft alternative embodiment including a non-friction variable step drive mechanism.

Referring now to FIG. 10G, a camcrank assembly used as a non-friction variable speed drive mechanism is disclosed. In accordance with this embodiment, the camcrank drive system ## is composed of two camcrank assemblies, that is, an input drive camcrank assembly 84 and an output drive camcrank assembly 46, connected together with a connecting membrane 85. The output drive camcrank assembly 46 is provided with a free spinning disc 91. As with the prior embodiments, the output drive camcrank assembly 46 also includes a round center disc 51A with the offset driveshaft 87 mounted a defined offset distance from the center of the center disc 51A. The free-spinning disc 91 is installed around the outer perimeter of the center disc 51A. A bearing surface ## is provided between the outer diameter of the center disc 51A and the inner diameter of the free-spinning disc 91 to allow full free rotation of the free-spinning disc 91 relative to the round center disc 51A.

Similarly, the input drive camcrank assembly 84 is provided with a free spinning disc 92. The input drive camcrank assembly 84 also includes a round center disc 51B with the offset driveshaft 86 mounted a defined offset distance from the center of the center disc 51B. The free-spinning disc 92 is installed around the outer perimeter of the center disc 51B. A bearing surface 93 is provided between the outer diameter of the center disc 51B and the inner diameter of the free-spinning disc 92 to allow full free rotation of the free-spinning disc 92 relative to the round center disc 51B.

In this configuration, a source of rotational power (not shown) applies rotational power to the offset input drive shaft 86, which power is then transferred to the input drive camcrank assembly 84. The rotational power from the input drive camcrank assembly 84 is then transferred from the connecting membrane 85 to the output camcrank assembly 46, which is then transferred to the offset output driveshaft 87.

With the embodiment shown in FIG. 10G, the amount of power transferred from the offset input drive shaft 86 to the offset output drive shaft 87 can be varied from zero to 100 percent by adjusting the amount of slack in the connecting membrane 85. The timing of the amount of slack in the connecting membrane 85 is adjusted by rotation of two membrane coiling mechanisms 83A, 83B or by timing the slack using an ancillary timing cam assembly 17, as described previously in FIG. 2. The coiling mechanisms 83A, 83B are respectively connected to the first and second ends 85A, 85B of the connecting membrane 85 wherein coordinated rotation of the coiling mechanisms 83A, 83B loosens or tightens the connecting membrane 85 as it engages the input drive camcrank assembly 84 and an output drive camcrank assembly 46. Both of the membrane coiling mechanisms 83A, 83B have outer gear teeth that are meshed to produce synchronized rotational motion. A single membrane coiling gear 88 is connected to the membrane coiling mechanism 83*a* to impart motion thereto and ultimately rotate both membrane coiling mechanisms 83A, 83B. Other methods of adjusting the length of the connecting membrane 85 can be applied to provide the desired timing of the power transmission process, such as the ancillary timing cam 17 embodiment shown in FIG. 2, hydraulic, electric, and computer or mechanically controlled actuators.

Figure 10H:
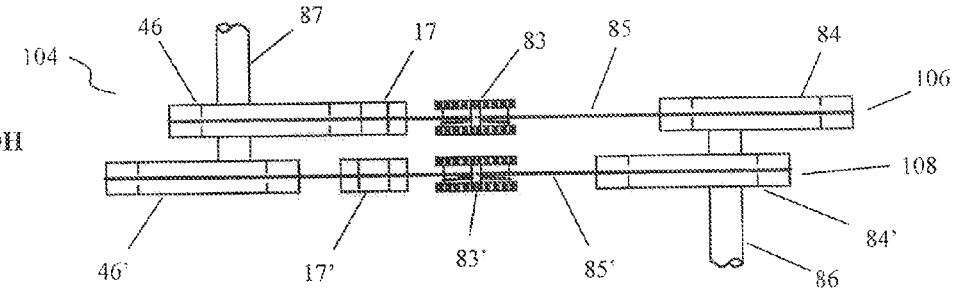
FIG. 10H shows atop view of non-friction variable step drive with adjacent assembly coupled with common input and output shafts.

FIG. 10H shows a top view of a camcrank drive system 104 similar that disclosed above with reference to FIG. 10G, but with a second assembly 106 installed adjacent to, at 180 degrees out of phase with the first assembly 108, wherein the first and second assemblies 106, 108 are substantially identical to the camcrank system disclosed above with reference to FIG. 10G. In accordance with this embodiment, the input drive shaft 86 and the output drive shaft 87 are connected to both the first and second input drive camcrank assemblies 84, 84' and the first and second output drive camcrank assemblies 46, 46'.

It is appreciated that the camcrank assemblies 84, 84' 46, 46' of the respective first and second assemblies 108, 106 are the same as those disclosed above with reference to FIGS. 10A, 10B and 10C, while the first and second connecting membranes 85, 85' connecting the respective first and second input drive camcrank assemblies 84, 84' and the first and second output drive camcrank assemblies 46, 46', the first and second membrane coiling mechanisms 83 and 83' and the timing cams 17, 17' (all of the respective first and second assemblies) are the same as that disclosed with reference to FIG. 10G.

It is appreciated that there could be any practical number of assemblies coupled together in a rotational sequence of 360 degrees divided by the number of camcrank assemblies, to provide smooth rotational output power coming out of the output drive shaft 87, at a different or same rotational velocity as the input drive shaft 86. The mechanism for causing the gear reduction is explained in the following paragraph.

Figure 10I:
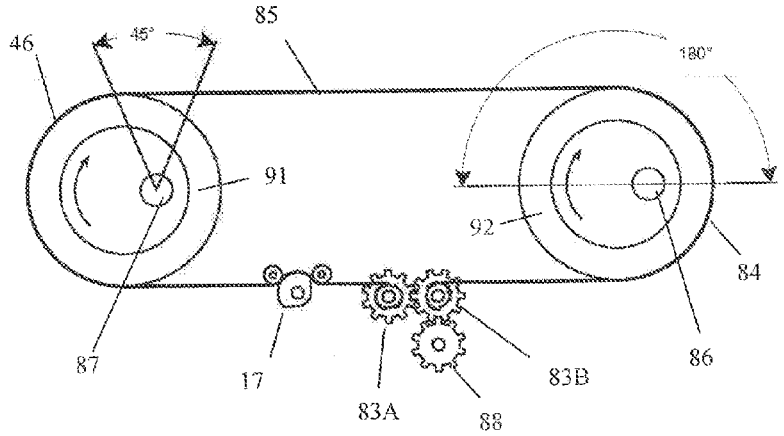
FIG. 10I shows timing example to illustrate 4:1 gear ratio.

According to FIG. 10I, the variable speed of the output drive shaft 87 is achieved due to the ranging velocity, from zero to maximum in the linear direction between points on the outer circumferences of the input drive camcrank assembly 84 and the output drive camcrank assembly 46, when the input drive camcrank assembly 84 is rotating. The variable speed output is achieved by selecting and varying the time of engagement of the connecting membrane 85 to the rotational motion of the input drive camcrank assembly 84. The selection and variation of the time of engagement of the connecting membrane 85 to the rotational motion of the input drive camcrank assembly 84, to produce the desired output rotational velocity at the output drive shaft 87, is achieved by orchestrating the appropriate length and contact time of the connecting membrane 85 by means of the membrane coiling mechanism 83, the ancillary cam device 17, or any other timing means. For example, if the slack of the connecting membrane 85 was timed to allow the input drive camcrank assembly 84 to spin freely for three revolutions without engaging the connecting membrane 85 to the output drive camcrank assembly 46, then it would engage on the fourth revolution, and then repeat this cycle, there would be a four-to-one (4:1) reduction in the output drive shaft 87 velocity relative to the input drive shaft 86 velocity. As illustrated in FIG. 10I, in this 4:1 gear reduction example, during the 180 degree power stroke rotation of the input drive camcrank assembly 84, the intentionally timing of the change of length of the connecting membrane 85 by the coiling mechanism 83 and or the ancillary cam device 17, there would be only 45 degrees of power transmission delivered to the output drive camcrank assembly 46.

Finer gear ratio adjustments could be made by actively adjusting the length of the connecting membrane 85 during each individual rotation, using the coil mechanism, ancillary cam device 17 with variable timing technology (not shown), or any other means, where the changing length of the connecting membrane 85 during each actual revolution will affect the rotational velocity of the input drive shaft 86 relative to the output drive shaft 87.

Similar to the embodiment shown in FIGS. 10A-10C, the stroke length would be four times the offset distance of the input drive shaft.

Figure 11A:
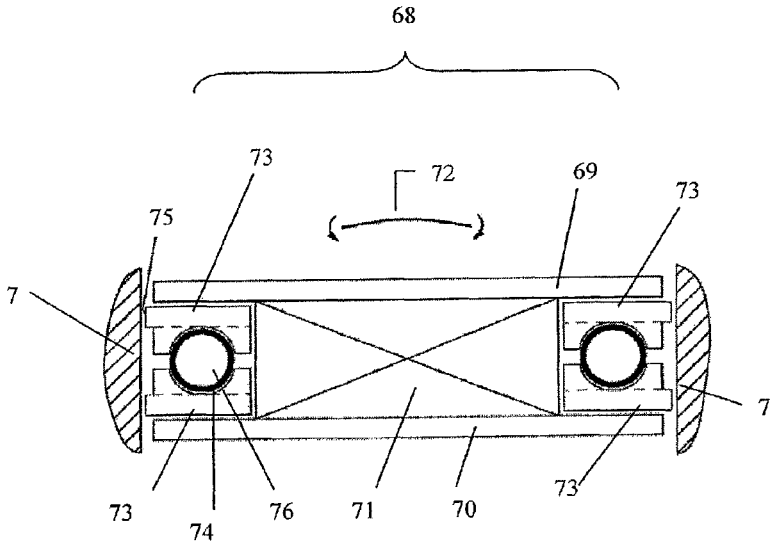
FIGS. 11A-11B show sectioned views of preferred embodiment of a flexible membrane.
Figure 11B:
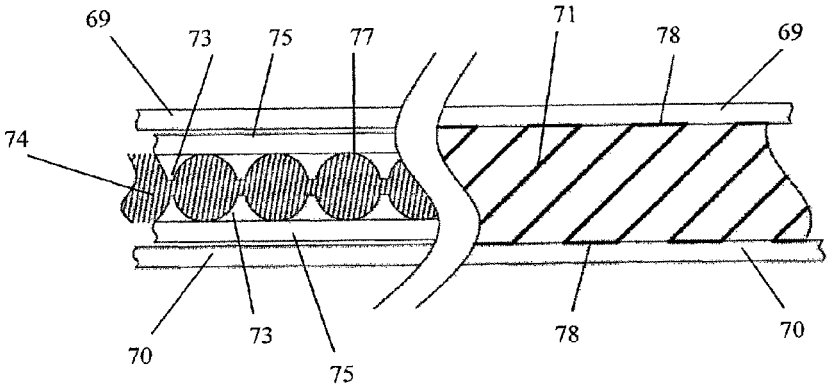

FIG. 11A and FIG. 11B show sectioned views of an embodiment of a flexible membrane assembly 68 to be used in the disclosed positive displacement motor and pumping apparatus invention. FIG. 11A shows a transverse cross section of the flexible membrane assembly 68. FIG. 11B shows a longitudinal sectioned view along a section of the length of the flexible membrane assembly 68.

FIG. 11A shows the flexible membrane assembly 68 comprised of two thin strips including an upper strip 69 and a lower strip 70, with the upper strip 69 and the lower strip 70 joined together by a corrugated mid-section 71. Together, the upper strip 69, the lower strip 70, and the corrugated mid-section 71 form a box structure that has a high level of rigidity in the transverse direction, as illustrated by the flexing arrows 72.

FIG. 11A also shows the flexible membrane assembly 68 comprised of linear seals 73 that fit in between the upper strip 69, lower strip 70, and corrugated mid-section 71. The linear seals 73 occur in pairs on each side of the flexible membrane assembly 68. Each pair of linear seals 73 is held in position by a spirally would spring tube 74. The spirally wound spring tube 74 is a flexible tube made of fine wire rolled into a precise continuous tubular structure that has the flexibility and elasticity characteristic of a spring.

As illustrated in FIG. 11A, the pair of linear seals 73 and the spring seal 74 is grouped together in between the space created by the upper strip 69, the lower strip 70, and the corrugated mid-section 71. In this configuration, the linear seals 73 operate as a form of piston ring that maintain a dynamic and movable seal between the sealing edges 75 of the linear seals 73 and the smooth sidewalls 7 of the invention. It is noted that the springlike characteristics of the spring seal 74 helps maintain pressure on the upper and lower linear seals 73 to keep then in place, much similar to the spacer rings used in conventional oil-type piston ring assemblies used extensively in modern internal combustion engines. The spring seal 74 creates a lubrication annulus 76 that allows for pressurized lubrication, for example engine oil, to run down the entire length of the flexible membrane assembly 68 during operation of the invention. The pressurized lubrication that runs down the lubrication annulus 76 serves at least two purposes. One purpose is to allow pressurized lubrication to uniformly press the linear seals 73 and the sealing edges 75 against the smooth sidewalls 7 of the invention. A second purpose is to provide lubrication and cooling to the contact area between the sealing edges 75 and the smooth sidewalls 7 of the invention.

FIG. 11B shows a composite side view of one transverse orientated side of the flexible membrane assembly 68. The spring seal 74 is provided within the confines of two linear seals 73. Also illustrated on the left side of FIG. 11B are the two linear seals 73 provided between the upper strip 69 and the lower strip 70.

The two linear seals 73 are comprised of cutouts 77 that allow the linear seals 73 to both retain the spring seal 76 in place and maintain flexibility in the transverse direction. It is noted that the thicknesses of the upper strip 69, the lower strip 70, and the sealing edges 75 are thin enough (0.040-inch or less) to allow the whole flexible membrane assembly 68 to be flexible and elastic, having the ability to flex over a radius of as small as 3.5-inches without plastic deformation or permanent set of the materials of construction.

The right side of FIG. 11B shows the construction of the corrugated mid-section 71. The right side of FIG. 11B has the two linear seals 73 and the spring seal 74 removed, to that the corrugated mid-section 71 is exposed. The corrugated mid-section 71 is permanently fixed between the upper strip 69 and the lower strip 70 by means of a bonding mechanism 78. The bonding mechanism 78 could be a braze join, weld, electrical spot weld, adhesive, or any other means of bonding. As shown on the right side of FIG. 11B, the corrugated mid-section 71 is a oriented in a angled position, close to 45 degrees. The purpose of placing the corrugated mid-section in an angled position is to allow the upper strip 69 to move a small distance toward the lower strip 70 during flexing of the flexible membrane assembly 68. This movement is important for both flexing characteristics of the membrane assembly, and for sealing characteristics of the exhaust cam 9 (FIG. 1) and the pivoting idler assembly 48 (FIG. 10A). It should be understood that during operation of the invention it may be that all of the tension of the flexible membrane assembly 68 is transmitted though either the upper strip 69 or the lower strip 70 and not both, and that either the upper strip 69 or the lower strip 70 may not be in a loaded condition.

In summary, the primary purpose of the flexible membrane assembly 68 is to produce a flexible membrane that is highly flexible in the longitudinal (lengthwise) direction and yet very rigid in the transverse (crosswise) direction. The flexible membrane assembly 68 described in FIGS. 11A and 11B has dynamic sealing capability with pressurized lubrication for good wearing capability of for long life. The high tensile strength of thin strips of either metallic (allow steel) or composite materials allows for the construction of a flexible membrane assembly 68 with very high tensile load capabilities.

Figure 12A:
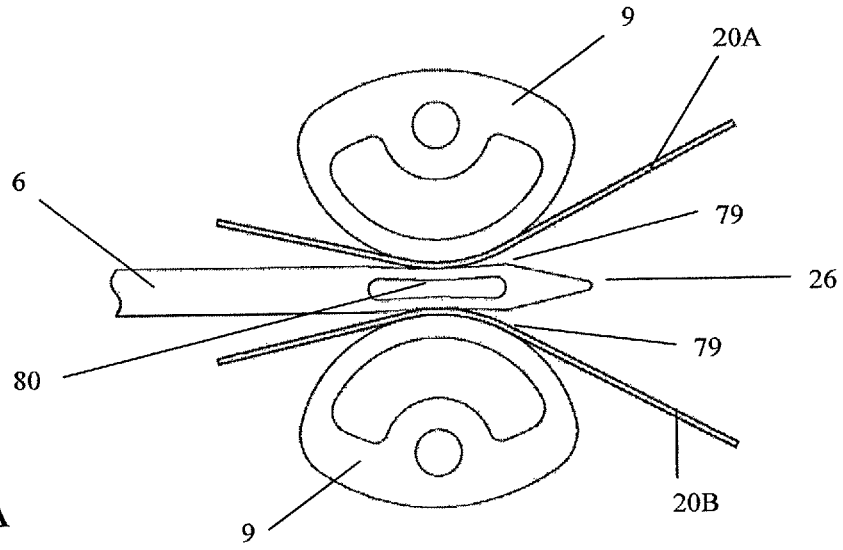
FIGS. 12A-12B show side views of the exhaust cams in both the open and closed positions.
Figure 12B:
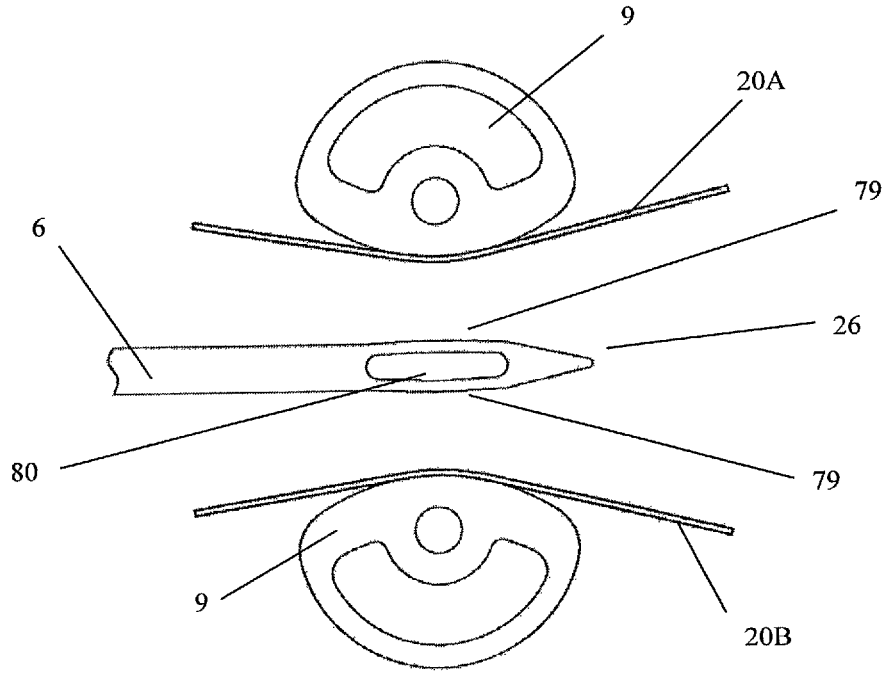

FIG. 12A and FIG. 12B show side views of the exhaust cams 9 in both the open and closed positions. In the closed position, as shown in FIG. 12A, the exhaust cams 9 are shown making contact with the two opposing membranes 20A and 20B at the pinch zone 79 portion of the base plate 6. FIG. 12B shows the exhaust cams 9 in the open position. The purpose and mechanism of sealing and rotation of the exhaust cams 9 are described in more detail in the descriptions of FIGS. 1, 2 and 3.

FIG. 12A shows the area just forward of the exhaust tail 26 portion of the base plate 6 being comprised of a flexing cavity 80. The flexing cavity 80 allows elastic deformation of the base plate 6 at the location of the pinch zone 79 associated with the rotating exhaust cams 9. The elastic deformation of the flexing cavity 80 allows for the exhaust cams 9 to be less precisely located, because of the forgiving tolerances associated with the elastic "giving" of the pinch zone 79 by the elastic deformation of the flexing cavity 80 moving to accommodate the interference fit of the rotating exhaust cams 9 as they press and seal the two opposing membranes 20A and 20B at the pinch zone 79.

FIG. 12B shows the exhaust cams 9 in the open position with the elastic cavity 80 flexed back to its unloaded position. When the rotating exhaust cams 9 are in the position where they are no longer pressing the two opposing membranes 20A and 20B at the pinch zone 79, the flexing cavity 80 elastically flexes back to its unloaded position. The elastic flexing of the flexing cavity 80 accommodates the sealing action of the two opposing membranes 20A and 20B at the pinch zone 79. The flexing cavity 80 can be pressurized with lubricating oil with the appropriate O-ring seals (not shown) or filled with an elastomeric (rubber) material to assist in the elastic flexing actions between the open and closed exhaust cam 9 positions. The flexing cavity could also be vented to the pressurized expansion zone 4, see FIG. 1, so that the pressure during the power stroke assists in the elastic sealing action. The flexing cavity 80 could be and independent part and not continuous to the base plate 6 or the exhaust tail 26.

Figure 13:
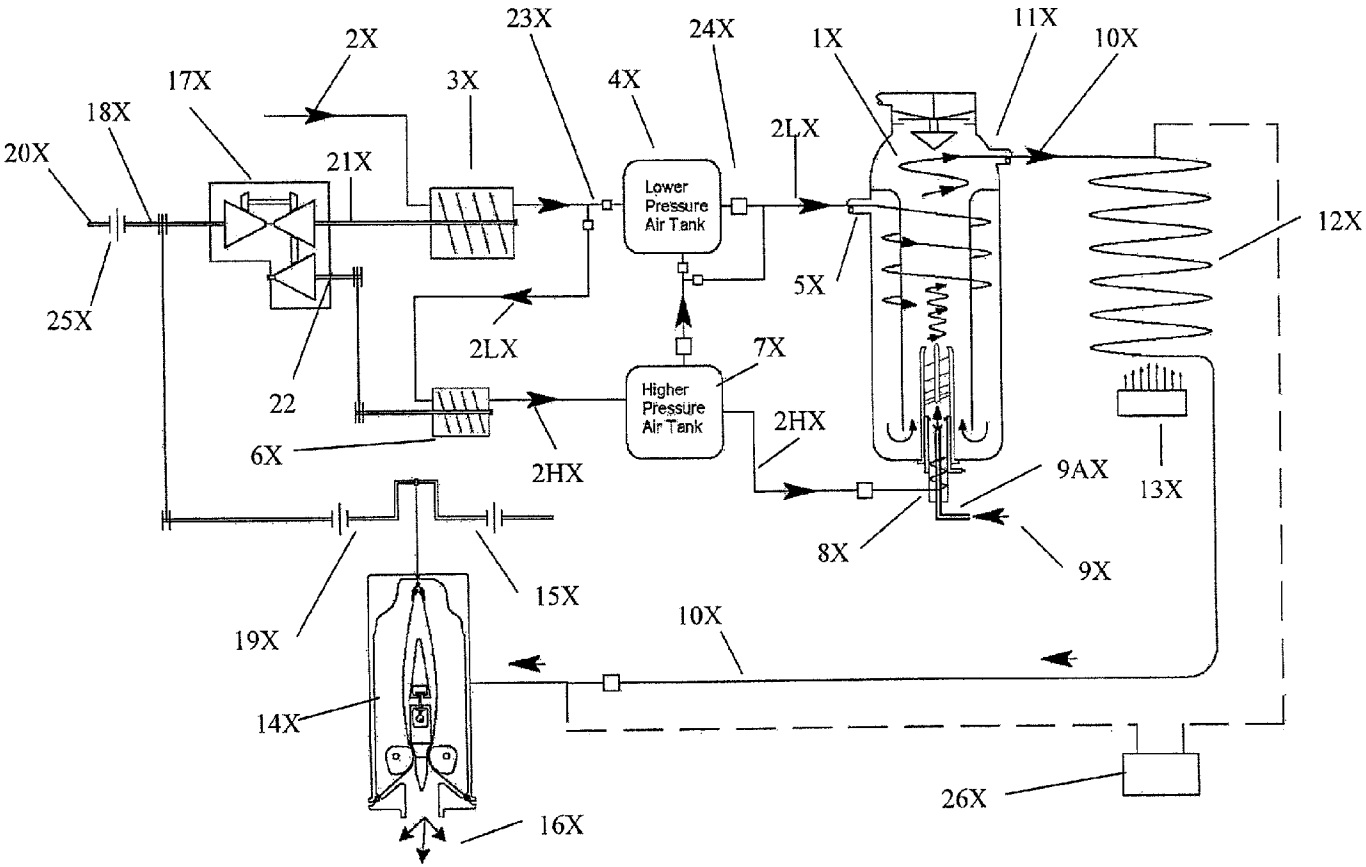
FIG. 13 shows one embodiment of the complete cycle and components comprising an external combustor, compressors, a series of variable speed transmissions, storage tanks for air at higher and lower pressure, an outlet heat transfer and flow buffer, controls, and pressure driven motor.

FIG. 13 shows a diagram of a preferred embodiment of the external combustion device or combustor 1X and a collection of ancillary components.

As shown in FIG. 13, a preferred configuration of the invention includes an air supply 2X that enters a lower pressure compressor 3X and exits as a compressed air supply that is directed to a pressurized storage tank 4X. A portion of the pressurized air exiting from the supply tank 4X would then enter a pressure inlet 5X provided in an upper portion of the external combustor 1X. Preferably, air entering the inlet 5X would enter the external combustor 1X tangentially to produce and spiralling flow pattern.

As shown in FIG. 13, a portion of the compressed air 2LX exiting the compressor 3X would be diverted to a higher pressure compressor 6X and exits as a higher pressure compressed air supply 2HX that is directed to a high pressure compressed air storage tank 7X. It is noted that the compressed air exiting the compressor 3X and stored in storage tank 4X is at a lower pressure than the air 2HX exiting the compressor 6X and stored in storage tank 7X. The higher pressure compressed air supply 2HX then exits the storage tank 7X and is directed through a higher pressure inlet 8X into a lower portion of the external combustor 1X. The higher pressure air supply 2HX is then mixed with an organic fuel 9X supplied through an interconnecting fuel supply port 9AX. The higher pressure air supply 2HX and the organic fuel mixture will combust within the to lower portion of the external combustor 1X, as will be subsequently explained, and the combusted mixture of the higher pressure air supply and the organic fluid 9X combine with the lower pressure air supply 2LX within the external combustor 1X.

As shown in FIG. 13, after the two streams of air supply 2LX and 2HX and the organic fuel 9X are combusted, details of which are provided later in the description of FIG. 2X, hot pressurized gas 10X exits the external combustor 1X at the external combustor outlet 11X. After exiting the external combustor 1X the hot gases 10X enter an ancillary combustion conditioner 12X. The combustion conditioner 12X allows time and direction for the hot gases 10X to become more laminar in flow characteristics, resulting in a harnessing of the acoustic noises and turbulence energies into additional gas volume, and allows for ancillary heat transfer either to, or from, the hot gases 10X by means of an ancillary heat exchanger 13X. The ancillary heat exchanger 13X can be used to input heat energy for source including solar generated heat or combustion waste heat, as long as the heat coming off the ancillary heat exchanger 13X is higher than the hot pressurized gas 10X stream. It is possible that with adequate heat coming from the ancillary heat exchanger 13X that this invention could produce mechanical power at the output shafts 15X and 19X solely on solar or waste heat.

As shown in FIG. 13, after exiting the ancillary combustion conditioner 12X the hot pressurized gas 10X enters a pressure driven motor 14X, where an output shaft 15X delivers rotational work energy to where it is needed, for example to drive the wheels of automobile or truck. After the energy of the pressurized hot gas 10X is expended in the pressure driven motor 14X it is released out of an exhaust port 16X.

Also shown in FIG. 13 is a preferred embodiment of the mechanical drive components of the present invention. A multi-output transmission 17X is configured to transmit input power from a rotating input shaft 18X to either or both the lower pressure compressor 3X or the higher pressure compressor 6X. The power to drive the multi-output transmission 17X could come from an power take-off shaft 19X from the pressure driven motor 14X, an input shaft 20X configured to a drivetrain, regenerative braking (not shown), or an ancillary power unit such as an electric motor (not shown).

As shown in FIG. 13, a lower pressure transmission output shaft 21X is connected to the lower pressure compressor 3X. A higher pressure transmission output shaft 22X is connected to the higher pressure compressor 6X. The multi-output transmission 17X would preferably be configured with a continuously variable gearing to perfectly match the compressor outputs to the pressurized air 2X demands of the external combustor 1X, including acceleration, deceleration (regenerative braking), idle (no ideal, or air supply tank re-pressurizing), and straight and level cruising. Examples of typical loading conditions are provided later in this application.

As shown in FIG. 13, this preferred embodiment of the invention is configured with a series of valves 23X, flow controls 24X, and clutch mechanisms 25X that would be configured to optimized pumping and flow requirements for all operating conditions, and would be controlled by electronic components and computers. Also provided as an example, is the configuration of a controller 26X that monitors demand by means of interpreting the pressure differential between two points in the circuit. Examples of general operating conditions are provided later in this application.

Figure 14:
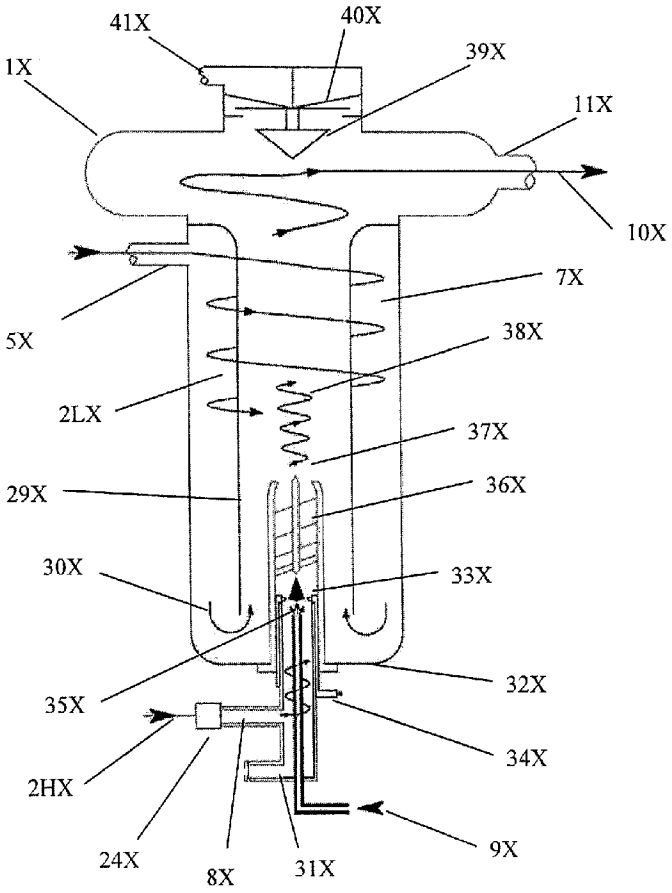
FIG. 14 shows a sectioned view of the external combustion device.

FIG. 14 shows a closer view of one preferred embodiment of the external combustor 1X. The lower pressure air supply 2LX enters the external combustor 1X through the lower pressure inlet port 5X that is configured with a tangential entry angle that imparts angular or rotational velocity to the lower pressure air supply 2LX. The path of the rotational air supply 2LX is dictated by an annular space 27X that exists between an outer wall 28X and an inner barrier wall 29X. The path of the lower pressure air supply 2LX enters the annular space 27X and continues in a downward spiral around the annular space 27X until it reaches the bottom 30X of the inner barrier wall 29X, forcing the lower pressure air supply 2LX to make a directional change and travels, while maintaining angular momentum, upward toward the upper portion of the external combustor 1X in the direction of the outlet 11X.

As shown in FIG. 14, the higher pressure air supply 2HX that enters though the higher pressure inlet port 8X installed into an igniter manifold 31X provided in the bottom endcap 32X of the external combustor 1X. The higher pressure air supply 2HX enters the igniter manifold 31X then mixes with fuel 9X from the fuel supply port 9AX and is then ignited by an electronic spark igniter 33X, 34X, forming a primary flame 35X. This primary flame can be fuel-rich, fuel-lean, or stoichiometric. The primary flame 35X then travels upwardly through a stator nozzle 36X preferably made of a ceramic material that imparts an angular flow velocity at the primary flame exit 37X.

At the point of the primary flame exit 37X, the pressure of the primary flame 35X has dropped due to the extremely high velocity imparted to the primary flame flow and the resistance pressure drip caused by the stator nozzle 36X. At this point the pressure of the primary flame 35X should be slightly higher or equal to the pressure of the low pressure air supply 2LX, and the two mix together in a mixing swirling pattern 38X, combining to form the hot pressurized gas 10X that exits the outlet 11X to conduct work.

It is noted that in a fuel-rich mixture there would be additional combustion in the mixing swirling pattern 38X region. The higher temperatures in this region would be isolated from the walls of the inner barrier walls 29X due to the tendency of the hot gasses being centrifuged toward the center of the swirling pattern 38X. The excess cooler, lower pressure air supply 2LX would tend to be centrifuged toward the outer circumference. The outer wall 28X of the external combustor 1X would be further isolated from the hot combustion gases in the swirling pattern 38X by the lower pressure air supply 2LX in the annulus space 27X.

Also shown in FIG. 14 is a pressure relief system 39X that activates if the pressure becomes too high in the external combustor 1X. In the event the pressure becomes too high a pressure relief spring 40X yields and allows the external combustor to depressurize through pressure relief outlet 41X.

Figure 15:
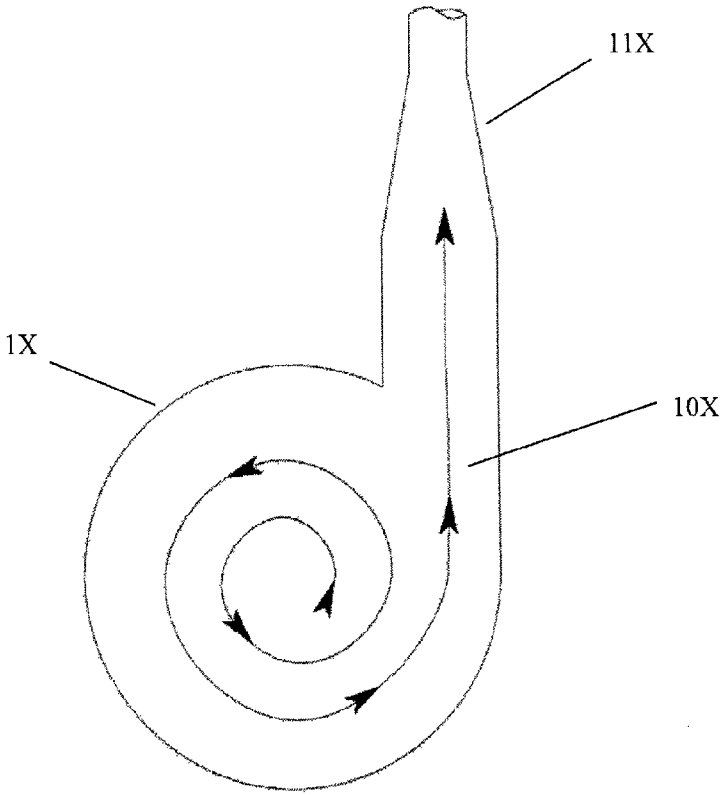
FIG. 15 shows a view of the flow pattern looking down from the top of the external combustor.

FIG. 15 shows one embodiment of external combustor 1X showing the top view of the flow pattern and the rotational velocity of the of the hot pressurized gases 10X exiting the external combustor 1X through the external combustion outlet 11X.

Figure 16:
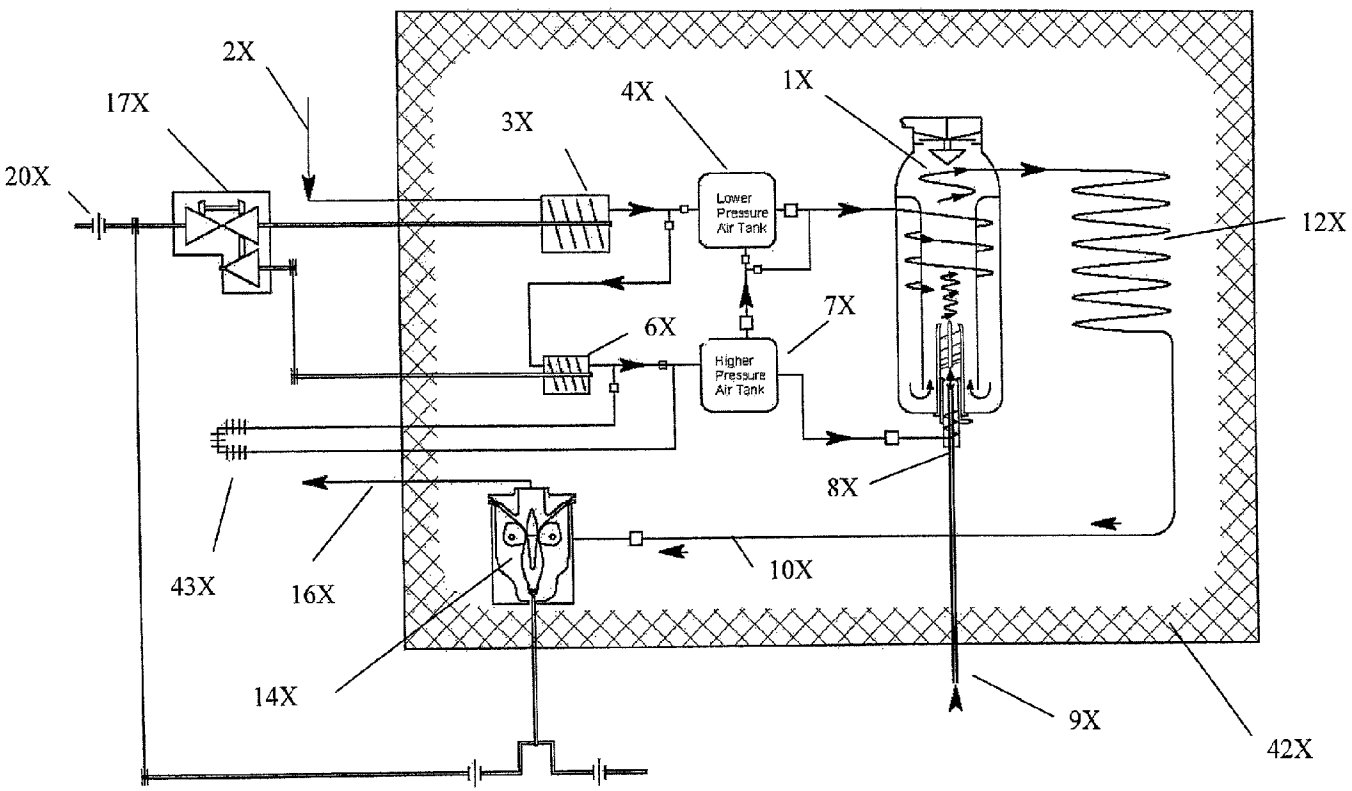
FIG. 16 illustrates the adiabatic characteristics of the complete cycle where all the heat generation and heat transfer produced by the specific components are conserved and no cooling is required.

FIG. 16 illustrates the adiabatic characteristics of a complete cycle where all the heat generation and heat transfer produced by the specific components are conserved and no cooling is required. Under any load condition, assuming that the materials of construction can operate under the working temperature of the systems, there is a conservation of heat energy inside a hypothetical thermal insulation 42X and none of the components of the system need cooling during operation. The principal of the no cooling requirement (inherent cooling) is similar to the operation of a commercially available air-motor, wherein no cooling is required because the expansion of the compressed air supply removes any heat that is generated by friction. In the case of where regenerative braking or "engine braking" is used to produce compressed air in the air tanks, an ancillary compressed air cooler 43X could be used to dump waste heat.

Operation Examples

Idle Operation

Under typical conditions there would be no idling or combustion when the vehicle is stopped, similar to an electric or hybrid vehicle. The whole system would not operate when at a stop, and would remain in a standby mode with the supply of compressed air in the air storage tanks 4X, 7X ready for initial acceleration. There may be conditions where the external combustor 1X and low pressure-gradient positive displacement motor 14 will run when the vehicle is at a full stop, for example, when it is necessary for heating or air conditioning, or when it is desired to fill the air storage tanks with compressed air for later use.

Acceleration

The external combustor 1X is not required to operate during initial acceleration because the energy to accelerate the vehicle from a dead stop could come from the pressurized air in the storage tanks 4X, 7X similar to the operation of an air motor. After the vehicle gets up to speed, combustion air and fuel can be injected into the igniter manifold 9X and the hot combustion gases can accelerate or maintain constant speed, or provide additional power input to the compressors 3X, 6X to fill up the air storage tanks 4X, 7X.

Straight & Level Cruise

During straight and level cruise is when the lower pressure compressor 3X and higher pressure compressor 6X are synchronized to provide the exact quantity and flow of compressed air to achieve the most optimum combustion and power output from the external combustor 1X. Excluding times when there is a desire to fill or empty the air storage tanks 3X, 6X, the straight and level cruise situation is where the only power consumed by the "drag" of the compressors 3X and 6X is that necessary for sustained combustion at the power output desired, similar to a conventional internal combustion engine, however, with a lot more efficient combustion, energy usage, and no cooling requirements.

Deceleration

Deceleration, whether going down a hill or braking to a stop, would always be accompanied by engaging the compressors 3X, 6X and storing the otherwise wasted stopping energy in the air storage tanks 4X, 7X. In situations where the storage tanks are already filled, the compressed air could be vented, at least saving the brakes from unneeded wear. The conventional hydraulic brakes would always be maintained as the primary braking power for emergency stops.

Figure 17:
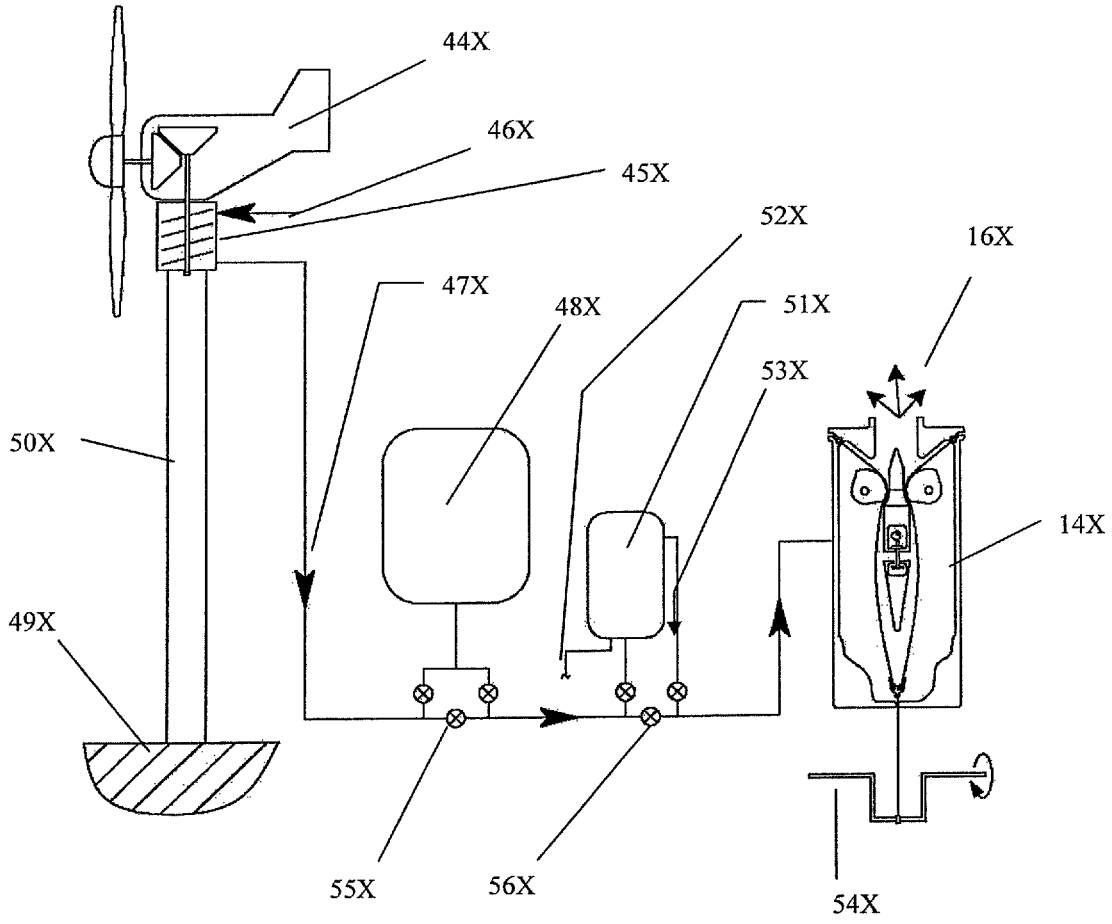
FIG. 17 shows the invention configured to use compressed air harnessed from a wind farm installation.

FIG. 17 shows an embodiment of the invention configured to use compressed air harnessed from a wind farm installation. In this design configuration, a windmill 44X is adapted to power a fluid compressor 45X with a fluid intake 46X, the fluid compressor 45X configured to produce compressed fluid 47X transmitted to a compressed fluid storage vessel 48X. The compressed fluid storage vessel 48X could take any form for storing compressed fluid including, but not limited to buried or elevated tanks, underground caverns, underwater gas containers of metal or non-metallic fabric, or liquefied cryogenic gases. The fluid compressor 45X could be an axial-flow, screw type, reciprocating type, or any other type of compressor or pumping apparatus. The fluid compressor 45X could be installed high above-grade adjacent to the windmill 44X, as shown in FIG. 17, or it could be installed at grade level 49X with a drive shaft (not shown) mounted down the center of the mounting pole 50*x* transmitting power from the windmill 44X to the fluid compressor 45X. The fluid compressor 45X could be configured with a continuously variable speed transmission (not shown) configured to adapt the speed of the windmill 44X to the optimum speed of the fluid compressor 45X.

As shown in FIG. 17, downstream of the compressed fluid storage vessel 48X is an optimal external combustion apparatus 51X with a fuel source 52X to supplement the energy content of the compressed fluid 47X produced by the windmill 44X. The external combustions apparatus 51X would be configured as described in FIGS. 13 through 16 of this application, and could involve ancillary compressors and gas storage systems as required to optimize the production of pressurized and heated fluid 53X to send downstream for the purpose of conducting work.

As shown in FIG. 17, downstream of the external combustion apparatus 51X is a low pressure positive displacement motor 14X, as described in FIGS. 1 through 7 and FIGS. 10 through 12 of this application. The low pressure positive displacement motor 14X is configured to use the compressed fluid 45X or the pressurized and heated fluid 53X for the primary purpose of conducting work through an output shaft 54X. The output shaft 54X could be connected to drive an electric generator (not shown), a pump (not shown) or any other mechanical device or need for rotational energy input. After passing through the low pressure positive displacement motor 14X the compressed fluid 45X or the pressurized and heated fluid 53*x* becomes a spent fluid 16X with its potential and kinetic energy removed and is either vented out to the atmosphere or is recirculated to the fluid intake 46X of the power cycle.

As shown in FIG. 17, there are standard bypass valve arrangements 55X & 56X located at both the compressed fluid storage vessel 48X and the external combustion apparatus 51X. The purpose of the bypass valve arrangements 55X, 56X is to allow each sub system to be added or taken off line during operation of the power cycle. For example, during times of high wind and no power requirement at output shaft 54X, the bypass valve arrangement 55X located at the fluid storage vessel 48X would be positioned so that all of the compressed fluid 47X generated from the windmill 44X would go to the compressed fluid storage vessel 48X to be saved. During times of high power demand and low wind conditions, the bypass valve arrangements 55X would be positioned to allow the release of the compressed fluid 47X stored in the compressed fluid storage vessel 48X to be sent downstream toward the external combustion apparatus 51X and low pressure differential motor 14X. The bypass valve arrangements 56X associated with the external combustion apparatus 51X would also be positioned based on the option of whether or not an external fuel source 52X is desired to produce a supplemental pressurized and heated fluid 53X for the desired output shaft 54X power requirements.

Figure 18A:
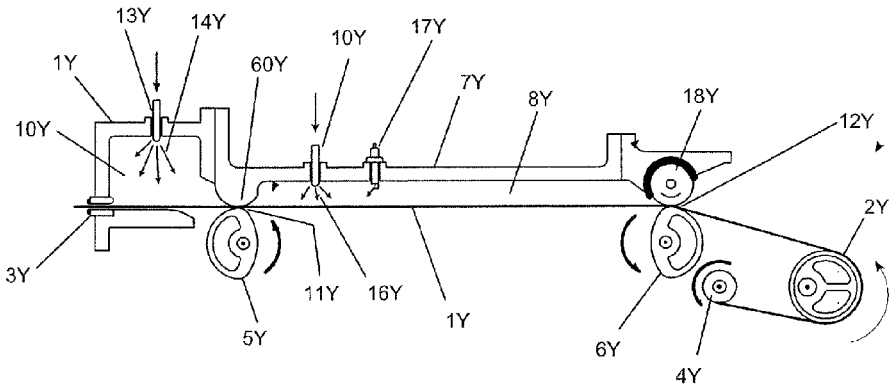
FIGS. 18A-18C show sectional views of a rotational combustion cycle with a separate compressed air chamber, fuel injection, and spark injection of a pressure driven apparatus, according to the present invention.
Figure 18B:
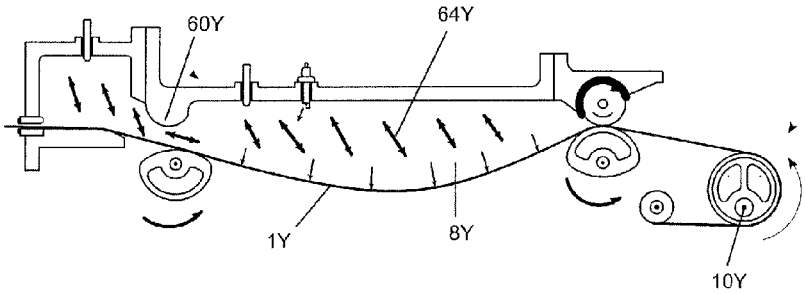
Figure 18C:
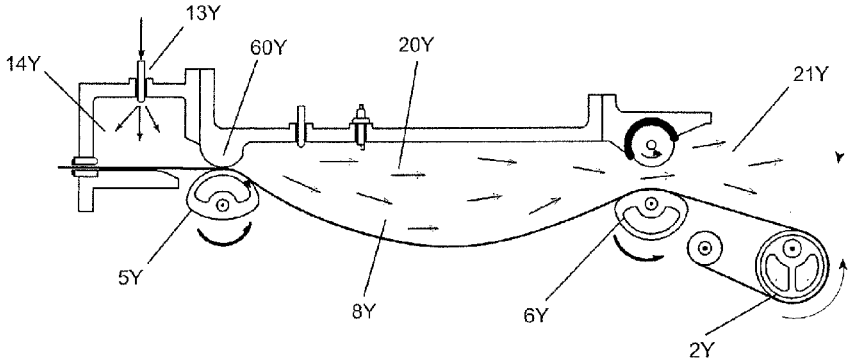

FIGS. 18A, 18B and 18C show sectional views of the present invention in various positions of the rotational combustion cycle of the present invention. A flexible membrane 1Y applies force to a form of crankshaft alternative comprised of a camcrank assembly 2Y for the development of rotational torque and power output. A detailed description of the positions of the rotational cycle is described with respect to FIGS. 1, 2, 3 and 10.

FIG. 18A shows the camcrank assembly 2Y at top-dead center. FIG. 18B shows the camcrank assembly 2Y at a position halfway through the power stroke. FIG. 18C shows the camcrank assembly 2Y at a position halfway through the exhaust stroke.

With reference to FIG. 18A, the flexible membrane 1Y is connected between a fixture point 3Y and a rotatable point 4Y. The membrane 1Y is provided with a crankcase having two side walls similar to the embodiment shown in FIGS. 1A-1D. There is a span created with the flexible membrane 1Y by the placement of two cam assemblies, including an intake cam assembly 5Y and an exhaust cam assembly 6Y contacting the bottom of the flexible membrane 1Y. The area formed by the span created by the two cam assemblies 5Y and 6Y, the membrane 1Y, and a top plate 7Y, is defined as an expansion zone 8Y. The end of one side plate of the top plate 7Y is provided with a protuberance 60Y in proximity with the intake cam assembly 5Y.

An intake chamber 10Y is formed to one side and above the intake cam 5Y and the protuberance 60Y. The top of the intake chamber 10Y includes an air injection nozzle 13Y provided in an intake chamber head 9Y for the injection of compressed air 14Y into the intake chamber.

Although not shown in FIGS. 18A, 18B and 18C, the device shown in those figures would include a crankcase and two side plates similar to the device shown in FIGS. 1A, 1B, 1C and 1D, thereby creating a sealed volume. As shown in FIG. 18A, an airtight seal would be formed for the volume in the expansion zone 8Y through the use of an intake pinch zone 11Y created by the flexible membrane 1Y provided between the protuberance 60Y and the cam assembly 5Y, and the top plate 7Y. This sealed volume is maintained by the creation of an exhaust pinch zone 12Y provided by the flexible membrane 1Y situated between a sealing bearing 18Y and the exhaust cam assembly 6Y. Additionally, the flexible membrane 1Y is wound around the exterior of a camcrank 2Y. As will be subsequently explained, movement of the flexible membrane 1Y during the combustion cycle will result in the movement of the camcrank 2Y, the camcrank 2Y provided with an output shaft 19Y.

A fuel injector 15Y is placed into the top plate 7Y for the injection of combustible fuel 16Y into the expansion chamber 8Y. A spark plug 17Y is placed into the top plate 7Y for the ignition of the fuel and air mixture included in the expansion zone 8Y. It is noted that the fuel injector 15Y and spark plug 17Y could also be installed within the intake chamber 10Y, or any other location within the apparatus that optimizes performance.

As previously described, an airtight seal at the exhaust pinch zone 12Y is created using the sealing bearing 18Y. The sealing bearing 18Y is precision fit and lubricated, either by pressure lubrication or self-lubricating materials, to form a rotating airtight seal at the exhaust pinch zone 12Y during the cycles shown in FIGS. 18A and 18B.

FIG. 18A shows the rotational combustion sequence of the camcrank 2Y at top-dead-center of the power stroke. In the embodiment shown, the fuel injector 15Y injects fuel 16Y into the expansion zone 8Y at a point within the rotational vicinity of top-dead-center. As the fuel injector 15Y injects fuel into the expansion zone 8Y, the intake cam 5Y rotates in the direction shown by the arrow, thereby creating a passageway between the flexible membrane 1Y and the protuberance 60Y, thereby allowing the compressed air 14Y to flow from the intake chamber 10Y into the expansion zone 8Y, as shown in FIG. 18B. Either simultaneously or just after the fuel 16Y is injected, the spark plug 17Y ignites the fuel air mixture within the expansion zone 8Y to produce expanding combustion gases 64Y.

With reference to FIG. 18B, the rotational combustion cycle is shown at the halfway point, or 90 degrees, into the power stroke. The sequence of events described above for FIG. 18A, create a condition in which the pressure created by the expanding combustion gases 64Y impart hoop stress to the membrane 1Y. This hoop stress, or tension force, imparts a force on the camcrank 2Y, causing a torsion force on the output shaft 19Y. Due to the rotational timing placement of the cams for the power stroke cycle, the intake cam assembly 5Y remains open and the exhaust cam assembly 6Y remains closed. After approximately 180 degrees of rotation from top-dead center (180 degree position not shown), the intake cam assembly 5Y rotates to close the intake pinch zone 11Y, and the exhaust cam assembly 6Y rotates to open at the exhaust pinch zone 12Y, thus commencing the exhaust cycle of the rotational sequence. It is noted that the timing of the opening and closing of the intake cam assembly 5Y and exhaust cam assembly 6Y can be variable and adjusted. For example, the intake cam assembly 5Y can remain open for a period of rotation of approximately 10-degrees after the exhaust cam assembly 6Y opens to allow compressed air 14Y to assist the exhaust cycle, improve emissions, provide cooling, and purge the expansion zone 8Y with clean air.

With reference to FIG. 18C, the rotational combustion cycle is shown at the halfway point through the exhaust cycle, or at the 270 degree point of the rotational sequence. At this point in the rotational sequence, the intake cam assembly 5Y is in the closed position and the exhaust cam assembly 6Y is in the open position allowing exhaust gases 20Y to escape through the exhaust port 21Y. The exhaust gases 20Y are being forced out, or pumped out, by the collapsing of the expansion zone 8Y caused by the pulling taunt of the membrane 1Y by the rotation of the camcrank 2Y. Similar to other internal combustion engines, the exhaust gases 20Y are also accelerated out towards the exhaust port 21Y by the relatively lower pressure in the vicinity of the exhaust port 21Y when compared to the center of the expansion zone 8Y.

During the rotational combustion cycle sequence between the approximate vicinity of bottom-dead-center, or 180 degrees, and top-dead-center, or 360 degrees, which includes that the position of 270 degrees shown in FIG. 18C, the intake cam 5Y is in the closed position. This closed position of the intake cam 5Y allows the intake chamber 10Y to fill with compressed air 14Y exiting from the air injection nozzle 13Y. The filling of the intake chamber 10Y during the exhaust cycle allows for the immediate availability and delivery of compressed air 14Y into the expansion zone 8Y for mixture with injected fuel 16Y during the next combustion and power stroke. In other words, the next combustion and power stroke do not have to wait for air to be pumped in through some conduit, rather, it is immediately "there" upon opening of the intake cam assembly 5Y.

It is noted that the motor configuration here described does not rely on combustion in the expansion zone 8Y to produce power to the output shaft 19Y. In other words, if the injector 15Y does not inject fuel 16Y, the compressed air 14Y from the air injection nozzle 13Y would fill the expansion zone 8Y and impart hoop stress to the membrane 1Y, and output power to the output shaft 19Y. Because of the high displacement characteristic of this invention, the pressures that occur in the expansion zone 8Y arc much less than what occurs in a typical internal combustion engine. For examples, the maximum pressures during combustion would be less than 200 psi. Again, this is achieved by the extremely high rate of expansion caused by the high displacement characteristic of the invention. The benefits of the rapid expansion and lower pressure combustion result in higher efficiency and lower emissions of NOx and CO.

FIGS. 18A, 18B, and 18C show the placement of a rotatable fixture point 4Y. As will be subsequently explained, the rotatable fixture point 4Y is also included in FIGS. 19 and 20. The purpose of the rotatable fixture point 4Y is to allow timing adjustment of the power stroke at any time after top-dead-center and before bottom-dead-center of the camcrank 2Y rotation. The benefits of this feature are to adjust the timing sequence of the power stroke for increased torque output, and are further discussed in the description of the timing cam 17, shown in FIG. 2, and the mechanical device 49 shown in FIG. 10. FIGS. 18A, 18B, and 18C, show the use of a rotating intake cam assembly 5Y and exhaust cam assembly 6Y. It is noted that any type of closing apparatus arrangement can be used, including cam and adjustable rocker arm assemblies, spacers, compressed air activated devices, electrically driven devices, belts, gears, or any other means. It is also noted that the flexible membrane 1Y can be partially affixed to a non-rotating cam assembly mechanism.

FIGS. 18A, 18B, and 18C, describe the injection of compressed air 14Y and injected fuel 16Y in the vicinity of top-dead-center of the camcrank 2Y rotation. It is noted that the injection of compressed air 14Y and fuel 16Y can occur at any point or duration during the power stroke. As noted before, the injection of fuel by the fuel injector 15Y and the compressed air injector 13Y, and the spark by the spark plug 17Y, can occur anywhere within the confined volume, including the expansion zone 8Y or compressed air chamber 10Y. Any type of igniter, such as a glow-plug or other electronic igniter, could used instead of a spark plug 17Y.

Figure 19A:
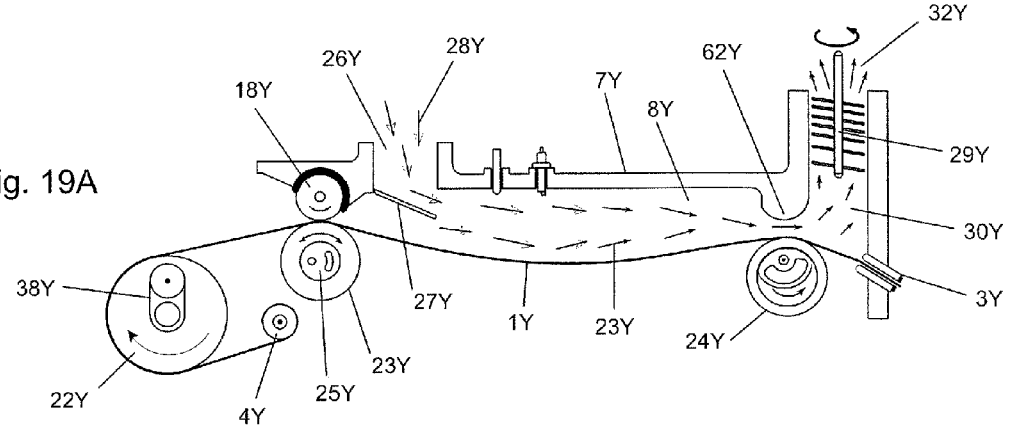
FIGS. 19A-19C show sectional views of a rotational combustion cycle of a pressure driven apparatus, according to the present invention.
Figure 19B:
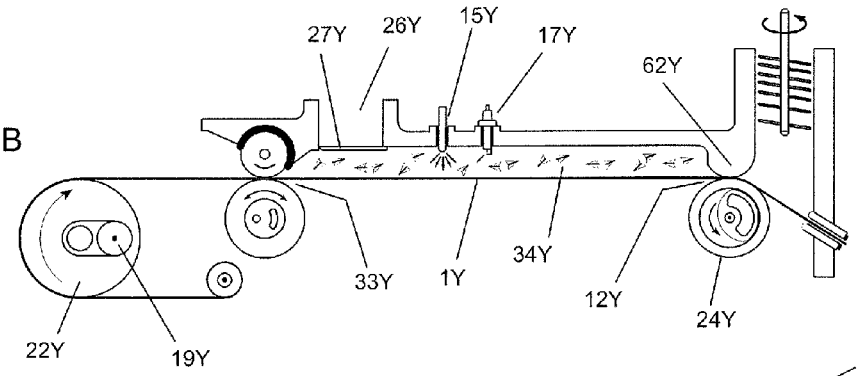
Figure 19C:
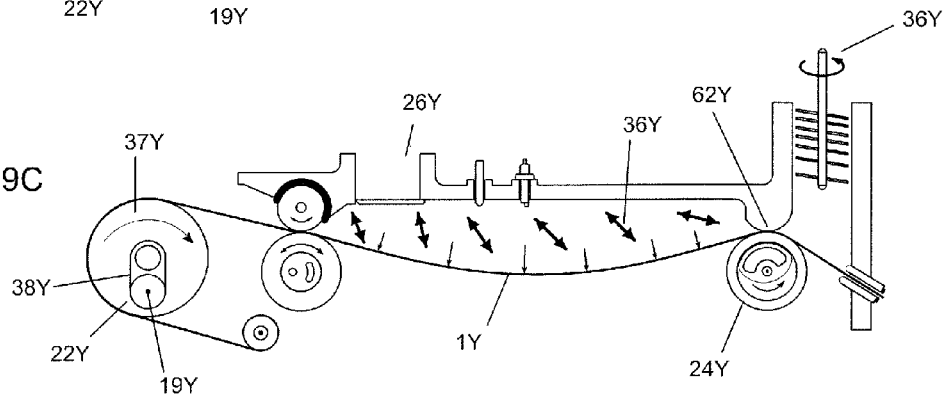

FIGS. 19A, 19B, and 19C show sectional views of a preferred embodiment of the invention in various positions of the rotational combustion cycle in which the flexible membrane 1Y applies force to a modified form of a crankshaft, such as a pulley-crank assembly 22Y, for the development of rotational torque and power output. For a detailed description of the positions of the rotational combustion cycle see drawings and descriptions of FIGS. 1, 2, 3, 10 and 18. FIG. 19A shows the pulley-crank 22Y at halfway through the quasi-exhaust stroke. This stroke is denoted as a quasi-exhaust stroke because the exhausting of the spent combustion gases is accompanied by the intake of fresh air during the same stroke, similar to the device shown in FIGS. 18A, 18B and 18C. FIG. 19B shows the pulley-crank 22Y at top-dead-center. FIG. 19C shows the pulley crank 22Y at a halfway point through the power stroke.

With reference to FIG. 19A, the flexible membrane 1Y is connected between fixture point 3Y and rotatable fixture point 4Y. A span is created with the flexible membrane 1Y by the placement of an idler pulley 23Y and an exhaust cam assembly 24Y. The idler pulley 23Y is described in FIG. 10 as item 47, however, in this case the idler pulley 23Y has an adjustor pivot 25Y to allow adjustment of the idler pulley 23Y onto the flexible membrane 1Y. Similar to FIG. 18A, the area formed by the span created by the idler pulley 23Y, the sealing bearing 18Y, the exhaust cam assembly 24Y, the membrane 1Y, and the top plate 7Y, is defined as the expansion zone 8Y.

Located in or in the vicinity of the top plate 7Y is an intake port 26Y. The intake port has a reed valve 27Y is a form of one-way valve, or "check valve", that allows atmospherically pressured air 28Y to enter into the expansion zone 8Y, and prevents gas from exiting the expansion zone 8Y. It is noted that in contradistinction to the device shown in FIGS. 18A, 18B and 18C having the rotatable cams, the device shown in FIGS. 19A, 19B and 19C only employs a single cam assembly 24Y.

FIG. 19A shows the quasi-exhaust stroke portion of the rotational combustion cycle occurring past the open exhaust cam assembly 24Y. A passageway is provided between a protuberance 62Y extending downward from a side wall of the top plate 7Y and the open exhaust cam assembly 24Y. Located downstream of the exhaust cam assembly 24Y is an exhaust fan 29Y. The exhaust fan 29Y creates a low pressure area in the exhaust chamber 30Y which, with the exhaust cam 24Y in the open position, causes an extraction of the spent combustion gases 31Y out of the expansion zone 8Y and out of an exhaust port 32Y.

As shown in FIG. 19A, during the quasi-exhaust stroke portion of the rotational cycle, in addition to causing an exodus of the spent combustion gases 31Y, the low pressure in the exhaust chamber 30Y created by the exhaust fan 29Y causes a flow of fresh atmospherically pressured intake air 28Y to enter through the open intake port 26Y and flow past the reed valve 27Y into the expansion zone 8Y, displace the spent combustion gases 31Y, and fill the expansion zone 8Y with fresh air 28Y. This type of flow and displacement action is commonly used with 2-stroke type internal combustion engines.

FIG. 19B shows the pulley-crank assembly 22Y at top-dead-center. After the sequence described in FIG. 19A is complete, at approximately top-dead-center, the exhaust cam assembly 24Y closes and seals at the exhaust pinch point 12Y with the flexible membrane 1Y provided between the exhaust cam assembly 24Y and the protuberance 62Y. Since the flexible membrane 1Y is also provided between the sealing bearing 18Y and the idler pulley 23Y, creating a pinch point 33Y, the entire expansion zone is sealed. At some point in the vicinity of top-dead-center, the fuel injector 15Y injects fuel into the expansion zone 8Y creating a fuel-air mixture 34Y within the expansion zone 8Y. It is noted that the fuel-air mixture 34Y is at or near atmospheric pressure and at either a stoichiometric or leaner fuel-to-air ratio. The intake reed valve 27Y is held shut by a weak bias in the closed position, similar to a 2-stroke read valve. At some point during or after the injection of the fuel by the fuel injector 15Y, the igniter spark, such as plug 17Y ignites the fuel-air mixture 34Y.

FIG. 19C shows the pulley-crank assembly 22Y half way through the power stroke, or 90 degrees past the position shown in FIG. 19B. The fuel-air mixture 34Y shown in FIG. 19B has ignited and is now in the form of a combustion gas 35Y. However, it is noted that a continuous injection of fuel and ignition can be utilized. With the exhaust cam assembly 24Y in the closed position, the pressure of the combustion gas 35Y imparts hoop stress to the membrane 1Y and torsion force to the output shaft 19Y, as described in FIG. 18 and elsewhere in the description of this invention.

The embodiment of this invention shown in FIGS. 19A, 19B, and 19C, illustrates what the inventor calls an atmospheric combustion engine. The illustrations show the exhaust fan 29Y to be an axial flow type fan rotating about a singular shaft 36Y (see FIG. 19C). It is noted that any kind of mechanism can be used to create a low pressure zone 30Y including squirrel cage, screw-type, roots-type, rotary, circular, piston, diaphragm, turbine, coolers, condenser, diaphragm, venturi, centrifugal, or any other type of device that forces gas to move.

FIGS. 19A, 19B, and 19C, show the intake port 26Y open to atmosphere in what would be referred to as "normally aspirated". It is noted that any type air pumping or air moving mechanism could be used to increase the pressure of the intake air 28Y at the intake port 26Y. It is further noted, based on the prior description of this invention, that compressed air could be injected into the expansion zone 8Y to operate this embodiment of the invention on pressurized fluid, namely compressed air or combustion gases.

FIGS. 19A, 19B, and 19C, show the use of what is referred to as a pulley-crank assembly 22Y. This configuration has the same mechanical advantages of the camcrank (item 51 described in FIG. 10). This configuration, however, uses a freely rotating pulley 37Y loosely engaged to the "connecting rod" journal of a typical crankshaft 38Y, instead of a straight-through shaft, such as the drive shaft 52 shown in FIG. 10. It is noted that the direction of the rotation of the freely rotating pulley 37Y is opposite relative to the direction of rotation of the crankshaft 38Y.

FIGS. 19A, 19B, and 19C, show the use of an exhaust cam assembly 24Y. It is noted that any type of closing apparatus arrangement can be used, including cam and adjustable or non-adjustable rocker arm assemblies, spacers, compressed air activated devices, electrically driven devices, belts, gears, or any other means. It is also noted that the flexible membrane 1Y can be partially affixed to a non-rotating cam mechanism.

Figure 20A:
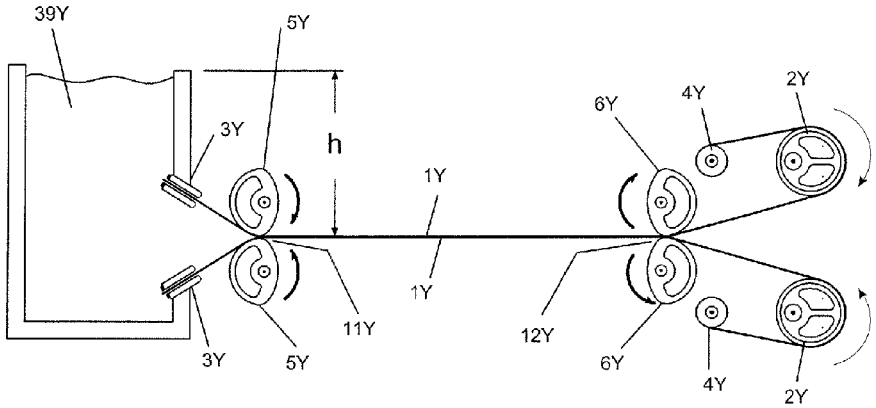
FIGS. 20A-20C show sectional views of a rotational cycle of invention used as a pressure driven apparatus supplied by a water column.
Figure 20B:
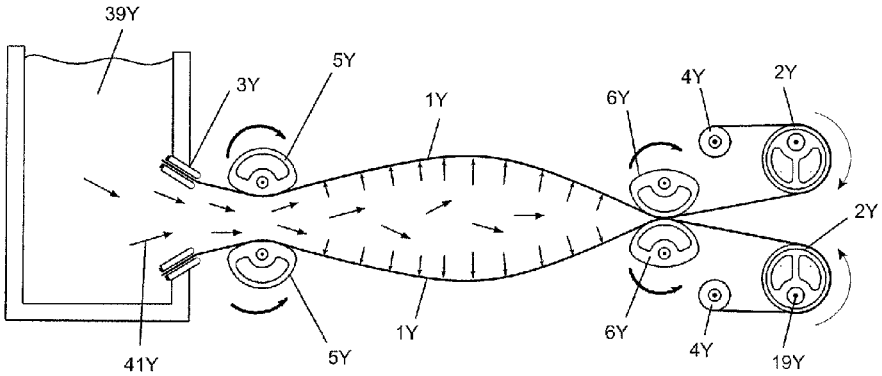
Figure 20C:
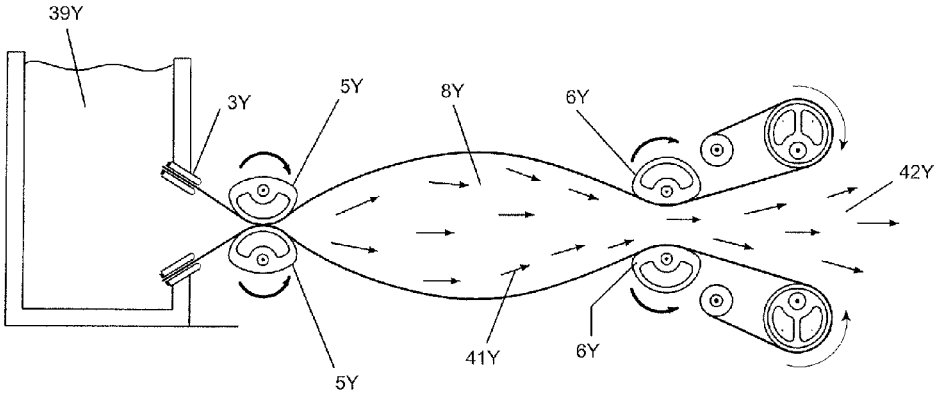

FIGS. 20A, 20B, and 20C show sectional views of the invention in various positions of the rotational combustion cycle in which a pair of flexible membranes 1Y apply force to a crankshaft comprised of a pair of camcrank assemblies 2Y for the development of rotational torque and power output. In this preferred embodiment of the invention, the energy used to produce the rotational power output is the head pressure of a water reservoir 39Y at a height of h 40Y about above the motor assembly. FIG. 20A shows the camcrank assemblies 2Y at top-dead-center. FIG. 20B shows the camcrank assemblies 2Y at a point halfway through the power stroke. FIG. 20C shows the camcrank assemblies 2Y at a point halfway through the exhaust stroke.

With reference to FIG. 20A, a pair of opposing flexible membranes 1Y is connected between points, including a pair of fixture points 3Y on the intake side and a pair of rotatable fixture points 4Y on the exhaust side. In the same manner as that described for FIGS. 18A, B, and C, a span is created with the flexible membranes 1Y by the placement of cams, including a pair of intake cam assemblies 5Y and a pair of exhaust cam assemblies 6Y. The area formed by the span created by the intake and exhaust cam assemblies 5Y and 6Y, and the membranes 1Y, is defined as the expansion zone 8Y, shown in FIG. 20B. This expansion zone 8Y is provided between the flexible membrane 1Y.

When the moving parts shown in FIGS. 20A, B, and C are placed between two side plates (not shown) the area of the expansion zone 8Y becomes sealed. The area becomes the sealed volume making the expansion zone 8Y created between the two membranes 1Y, the two side plates (not shown), the intake pinch zone 11Y, and the exhaust pinch zone 12Y.

FIG. 20A shows the rotational sequence at top-dead-center of the power stroke. At this approximate point in the rotational sequence, the intake cam assemblies 5Y are on the verge of opening to allow pressurized water from the water reservoir 39Y to enter into the expansion zone 8Y. As shown in FIG. 20A, the upper intake cam assembly 5Y rotates in the clockwise direction and the lower intake cam assembly 5Y rotates in the counter-clockwise direction. Additionally, the upper exhaust cam assembly 6Y rotates in the clockwise direction and the lower exhaust cam assembly 6Y rotates in the counter-clockwise direction.

With reference to FIG. 20B, the rotational cycle is shown at a halfway point, or 90 degrees into the power stroke. With the intake cam assemblies 5Y open and the exhaust cam assemblies 6Y closed the head pressure of the incoming feed water 41Y imparts hoop stress to the flexible membranes 1Y. This hoop stress, or tension force, imparts a force on the camcranks 2Y, causing a torsion force on the output shafts 19Y connected to the camshaft 2Y. Due to the rotational timing placement of the cams, during this power stroke the intake cam assemblies 5Y remain open and the exhaust cam assemblies 6Y remain closed. After approximately 180 degrees of rotation from top-dead-center (illustration not shown), the intake cam assemblies 5Y close and the exhaust cam assemblies 6Y open, and the exhaust cycle of the rotational sequence begins.

With reference to FIG. 20C, the rotational cycle is shown at a halfway point through the exhaust cycle, or at approximately 270 degrees of the rotational sequence from top-dead-center. At this point in the rotational sequence the intake cam assemblies 5Y are in the closed position and the exhaust cam assembly 6Y are in the open position allowing the feed water 41Y to escape out of an exhaust port 42Y into the lower pressure atmosphere. The feed water 41Y is forced out by the collapsing of the expansion zone 8Y caused by the pulling taunt of the membranes 1Y by the rotating camcranks 2Y, and also by gravity. At this point, the intake cam assemblies 5Y and the exhaust cam assemblies 6Y all contact the flexible membrane 1Y, thereby retaining the device to the position shown in FIG. 20A.

FIGS. 20A, 20B, and 20C, describe the preferred embodiment of the invention being used with a water reservoir 39Y. It is noted that this invention can be applied to pressure differentials occurring within any fluid or fluid driven mechanisms, including air, compressed air storage, thermal gradients, Sterling engines, heat transfer devices, combustible gases, combusted gases, or the like.

FIGS. 20A, 20B, and 20C, show the use of rotating intake cam assembly 5Y and exhaust cam assembly 6Y. It is noted that any type of closing apparatus arrangement can be used, including cam and adjustable rocker arm assemblies, compressed air activated devices, electrically driven devices, belts, gears, or any other means.

FIGS. 20A, 20B, and 20C, show two separate camcranks 2Y, with output shafts 19Y. In a typical application with the double camcranks 2Y the output shafts 19Y would be coupled together with a timing chain (not shown) or gear (not shown).

Figure 21A:
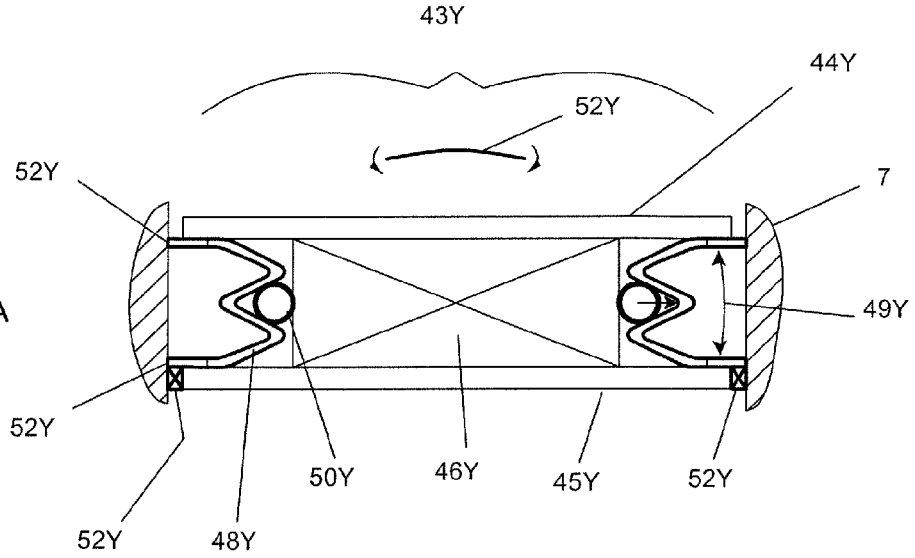
FIGS. 21A-21B show sectional views of an embodiment of a flexible membrane used in the pressure driven apparatus, according to the present invention.
Figure 21B:
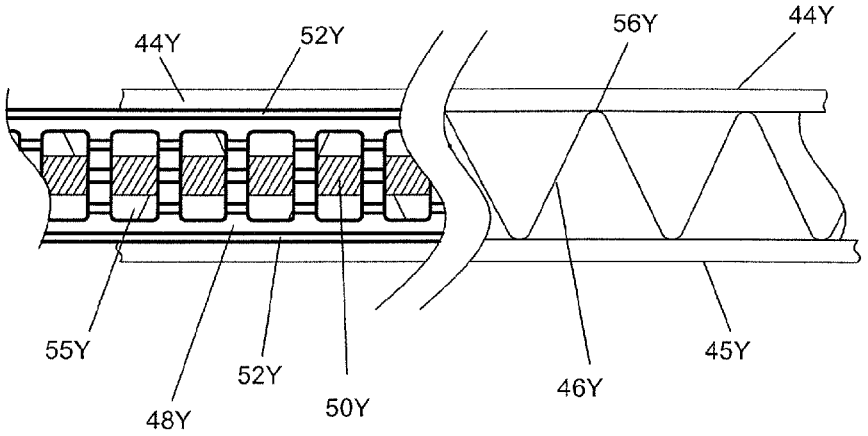

FIG. 21A and FIG. 21B show sectional views of a preferred embodiment of a flexible membrane assembly 43Y to be used in the disclosed positive displacement motor and pumping apparatus invention. FIG. 21A shows a cross section looking transversely to the flexible membrane assembly 43Y. FIG. 21B shows a sectional view looking longitudinally along a section of the length of the flexible membrane assembly 43Y.

FIG. 21A shows the flexible membrane assembly 43Y comprised of two thin strips including an upper strip 44Y and a lower strip 45Y, with the upper strip 44Y and the lower strip 45Y joined together by a corrugated mid-section 46Y. Together, the upper strip 44Y, the lower strip 45Y, and the corrugated mid-section 46Y form a box structure that has a high level of rigidity in the transverse direction, as illustrated by the flexing arrows 47Y.

FIG. 21A also shows the flexible membrane assembly 43Y comprised of rolled W-shaped seals 48Y that fit in between the upper strip 44Y, lower strip 45Y, and corrugated mid-section 46Y. The W-shaped seals 48Y fit tightly in between the upper strip 44Y and the lower strip 45Y in such manner that causes the W-shaped seals 48Y to spring apart and cause a sealing force 49Y against the upper strip 44Y and the lower strip 45Y. A tubular spring 50Y, preferably the same as that shown if FIGS. 11A and 11B, is shown exerting an outward force 51Y toward the side walls 7. The outward force 5W causes the W-shaped seals 48Y to impart a component force in the outward direction that presses the sealing surfaces 52Y of the W-shaped seals 48Y against the side walls 7. It is note that the tubular spring 50Y could have a round or squared cross-section, solid or hollow, and made of a metallic or non-metallic structure. It is also noted that the W-shaped seal 48Y could be used without the tubular spring 50Y and rely on the mechanical contact between the W-shaped seal 48Y and the corrugated mid-section 46Y to impart the said component of force in the outward direction that presses the sealing surfaces 52Y against the side walls 7.

As illustrated in FIG. 21A, the pair of W-shaped seals 48Y operate as a form of piston ring that maintain a dynamic and movable seal between the sealing edges 52Y of the linear seals 48Y and the smooth sidewalls 7 of the invention. The W-shaped seals 48Y, together with the tubular spring 50Y, create a lubrication annulus 53Y that allows for pressurized lubrication, for example engine oil, to run down the entire length of the flexible membrane assembly 43Y during operation of the invention. It is noted that the control of pressurized lubrication within the flexible membrane assembly 43Y can be used to effect a gas barrier seal to assist in the operational function of the sealing characteristics of the flexible membrane assembly 43Y. Also shown in FIG. 21A is the placement of a pair of ancillary seals 54Y that augment the sealing in the vicinity of the pinch zones 11Y, 12Y shown in FIG. 18A, and pinch zone 33Y shown in FIG. 19B, and shown in other drawings of this application.

FIG. 21B shows a composite side view of one transverse orientated side of the flexible membrane assembly 43Y. To best illustrate the construction of the flexible membrane assembly 43Y, we start at the left side of FIG. 21B showing the placement of the W-shaped seals 48Y within the confines of upper strip 44Y and a lower strip 45Y. The left side of FIG. 21B shows the W-shaped seals 48Y comprised of cut-outs 55Y that allow the W-shaped seals 48Y to flex with the cyclic curvature of the flexible membrane assembly 43Y. It is noted that the thicknesses of the upper strip 44Y, the lower strip 45Y, and the W-shaped seals 48Y are thin enough (0.10-inch or less) to allow the whole flexible membrane assembly 43Y to be flexible and elastic, having the ability to flex over a radius without plastic deformation or permanent setting of the materials of construction. The tubular spring 50Y is visible through the cut-outs 55Y in the W-shaped seals 48Y.

Moving over to the right side of FIG. 21B, the construction of the corrugated mid-section 46Y is illustrated. The W-shaped seals 48Y is removed from the right side of FIG. 21B exposing the corrugated mid-section 46Y. The corrugated mid-section 46Y is permanently fixed between the upper strip 44Y and the lower strip 45Y by means of a bonding mechanism 56Y. The bonding mechanism 56Y could be a braze joint, weld, an electrical spot weld, adhesive, or any other means of bonding. As shown on the right side of FIG. 21B, the corrugated mid-section 46Y is oriented in an angled position, close to 45 degrees.

In summary, the primary purpose of the flexible membrane assembly 43Y shown in FIGS. 21A and 21B is to produce a flexible membrane that is highly flexible in the longitudinal (lengthwise) direction and yet very rigid in the transverse (crosswise) direction. The flexible membrane assembly 43Y described in FIGS. 21A and 21B has dynamic sealing capability with pressurized lubrication for good wearing capability of for long life. The high tensile strength of thin strips of either metallic (alloy steel) or composite materials allows for the construction of a flexible membrane assembly 43Y with very high tensile load capabilities.

The above information describes the general operation low pressure-gradient positive displacement motor with examples of applications including the use of internal and external combustion apparatus. Unique to the present invention are injection, sealing, and exhaust devices and a relatively long flexible membrane acted on by a pressure differential to produce tension in the membrane and then transferring this tension to a crankshaft to produce a usable rotating power output. The pressure differential can be obtained from many sources.

Some benefits include:

A non-linear volumetric expansion zone.

Positive displacement expansion zone

More effective transference of pressure forces into linear or rotational movement.

Simple construction.

High displacement for unit size.

High torque high rpm potential.

Variable stroke length

Conducive to lubrication on all moving components

Adjustable power and exhaust stroke.

Inherent cooling by driving fluid that cools the motor.

Cannot be overloaded. Motor can be loaded to a complete stop without causing damage.

In the present specification and claims, the word "comprising" and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

The invention claimed is:

1. A camcrank drive system, comprising;

a first free-spinning disc provided around an outer perimeter of a first center disc;

a first driveshaft attached to the first center disc at a distance X from a center of the first center disc;

a connecting membrane extending around a portion of a circumference of the first free-spinning disc, a device for adjusting the length of the connecting membrane, wherein one end of the connecting membrane is connected to a power source, and a second end of the connecting membrane is attached to the device for adjusting the length of the connecting membrane.

2. The camcrank drive system according to claim 1, wherein the device for adjusting the length of the connecting membrane comprises a coiling mechanism.

3. The camcrank drive system according to claim 1, wherein the device for adjusting the length of the connecting membrane comprises a cam mechanism.

4. The camcrank drive system according to claim 1, wherein the power source is a push-pull mechanism connected to an electromagnetic drive.

5. The camcrank drive system according to claim 1, wherein the power source is a push-pull mechanism connected to a fluid powered mechanism.

* * * * *